US009283139B2

(12) United States Patent
Mayer et al.

(10) Patent No.: US 9,283,139 B2
(45) **Date of Patent: *Mar. 15, 2016**

(54) TREATMENT AND/OR PREVENTION OF MEDICAL CONDITIONS VIA COMPRESSION

(75) Inventors: Matthew J. Mayer, Grand Junction, CO (US); Peter E. Von Behrens, Grand Junction, CO (US); David M. Mayer, Grand Junction, CO (US); Gerhard B. Rill, Parachute, CO (US)

(73) Assignee: AVEX, LLC, Grand Junction, CO (US)

( * ) Notice: Subject to any disclaimer, the term of this patent is extended or adjusted under 35 U.S.C. 154(b) by 923 days.

This patent is subject to a terminal disclaimer.

(21) Appl. No.: 13/193,446

(22) Filed: Jul. 28, 2011

(65) Prior Publication Data

US 2012/0022413 A1 Jan. 26, 2012

Related U.S. Application Data

(63) Continuation-in-part of application No. 13/004,754, filed on Jan. 11, 2011, now Pat. No. 8,246,556, which is a continuation-in-part of application No. 12/499,473, filed on Jul. 8, 2009, now Pat. No. 7,909,783.

(60) Provisional application No. 61/078,847, filed on Jul. 8, 2008.

(51) Int. Cl.

| | |
|---|---|
| ***A61H 23/00*** | (2006.01) |
| ***A61H 1/00*** | (2006.01) |
| ***A61H 23/02*** | (2006.01) |

(52) U.S. Cl.

CPC ..... *A61H 23/02* (2013.01); *A61H 2201/018* (2013.01); *A61H 2201/165* (2013.01);

(Continued)

(58) Field of Classification Search

CPC ..... A61H 1/0266; A61H 2205/12; A61H 2205/125; A61H 7/00; A61H 9/00; A61H 39/04; A61H 2201/164; A61H 2201/1642; A61H 2201/1645

USPC ..... 601/22, 23, 26, 27, 29, 31, 89, 90, 92, 601/93, 97, 98, 100, 101, 104, 107, 108, 601/134, 136; 36/140, 141

See application file for complete search history.

(56) References Cited

U.S. PATENT DOCUMENTS 1,546,506 A * 7/1925 Naysmith ..... 606/237
2,397,428 A * 3/1946 Moshier ..... 601/27

(Continued)

FOREIGN PATENT DOCUMENTS

AT 506689 11/2009
CN 1486148 3/2004

(Continued)

OTHER PUBLICATIONS

Office Action dated Mar. 6, 2014 for patent application in China application No. 200980132527.7.

(Continued)

*Primary Examiner* — Justine Yu
*Assistant Examiner* — Douglas Sul
(74) *Attorney, Agent, or Firm* — Snell & Wilmer L.L.P.

(57) ABSTRACT

Methods and systems for dynamic compression of venous tissue enable improved blood movement in the extremities. In accordance with an exemplary embodiment, a pressure pad provides a compressive force to a portion of the human body. The pressure pad is successively withdrawn and re-pressed against the body. In this manner, prevention and/or treatment of various medical conditions may be achieved, for example restless leg syndrome, edema, plantar fasciitis, deep vein thrombosis, pulmonary embolism, venous insufficiency, wound care, and/or the like.

13 Claims, 14 Drawing Sheets

(52) U.S. Cl.
CPC . *A61H2201/5015* (2013.01); *A61H 2201/5038* (2013.01); *A61H 2201/5046* (2013.01); *A61H 2201/5061* (2013.01); *A61H 2205/12* (2013.01); *A61H 2209/00* (2013.01)

(56) References Cited

U.S. PATENT DOCUMENTS

| | | | | |
|---|---|---|---|---|
| 2,836,174 | A * | 5/1958 | Infanger | 601/27 |
| 3,612,043 | A * | 10/1971 | Inaki | 601/118 |
| 3,888,242 | A | 6/1975 | Harris et al. | |
| 3,917,261 | A | 11/1975 | Small et al. | |
| 4,166,329 | A | 9/1979 | Herbig | |
| 4,294,236 | A | 10/1981 | Hofstein | |
| 4,299,206 | A * | 11/1981 | Hofstein | 482/4 |
| 4,721,101 | A | 1/1988 | Gardner et al. | |
| 4,856,496 | A | 8/1989 | Chursinoff | |
| 5,176,624 | A | 1/1993 | Huehnreich | |
| 5,357,696 | A | 10/1994 | Gray et al. | |
| 5,407,418 | A | 4/1995 | Szpur | |
| 5,443,440 | A | 8/1995 | Tumey et al. | |
| 5,584,798 | A | 12/1996 | Fox | |
| 5,605,533 | A | 2/1997 | Badilla | |
| 5,674,262 | A | 10/1997 | Tumey et al. | |
| 5,682,690 | A | 11/1997 | Chang | |
| 5,688,225 | A | 11/1997 | Walker | |
| 5,931,797 | A | 8/1999 | Tumey et al. | |
| 6,135,116 | A | 10/2000 | Vogel et al. | |
| 6,234,987 | B1 | 5/2001 | Chen | |
| 6,319,215 | B1 | 11/2001 | Manor et al. | |
| 6,360,457 | B1 | 3/2002 | Qui et al. | |
| 6,585,669 | B2 * | 7/2003 | Manor et al. | 601/152 |
| 6,685,661 | B2 | 2/2004 | Peled | |
| 6,702,768 | B2 | 3/2004 | Mano et al. | |
| 6,893,409 | B1 | 5/2005 | Lina | |
| 7,107,706 | B1 | 9/2006 | Bailey, Sr. et al. | |
| 7,188,439 | B2 | 3/2007 | DiBenedetto et al. | |
| 7,219,449 | B1 | 5/2007 | Hoffberg et al. | |
| 7,282,038 | B2 | 10/2007 | Gillis et al. | |
| 7,310,895 | B2 | 12/2007 | Whittlesey et al. | |
| 7,318,291 | B2 | 1/2008 | Wang et al. | |
| 7,395,614 | B1 | 7/2008 | Bailey, Sr. et al. | |
| 7,506,460 | B2 | 3/2009 | DiBenedetto et al. | |
| 7,544,173 | B2 * | 6/2009 | Suzuki | 601/24 |
| 7,596,891 | B2 | 10/2009 | Carnes et al. | |
| 7,607,243 | B2 | 10/2009 | Berner, Jr. et al. | |
| 7,618,382 | B2 | 11/2009 | Vogel et al. | |
| 7,631,382 | B2 | 12/2009 | DiBenedetto et al. | |
| 7,676,960 | B2 | 3/2010 | DiBenedetto et al. | |
| 7,909,783 | B2 * | 3/2011 | Mayer et al. | 601/29 |
| 7,980,009 | B2 | 7/2011 | Carnes et al. | |
| 8,056,268 | B2 | 11/2011 | DiBenedetto et al. | |
| 8,308,665 | B2 | 11/2012 | Harry et al. | |
| 2002/0068884 | A1 * | 6/2002 | Alviso | 601/1 |
| 2002/0133106 | A1 | 9/2002 | Peled | |
| 2003/0139255 | A1 | 7/2003 | Lina | |
| 2004/0064974 | A1 * | 4/2004 | Schuster | 36/91 |
| 2005/0126049 | A1 | 6/2005 | Koenig | |
| 2005/0187496 | A1 | 8/2005 | Ho | |
| 2008/0010851 | A1 | 1/2008 | Avanzini | |
| 2008/0066343 | A1 | 3/2008 | Sanabria-Hernandez | |
| 2008/0072451 | A1 | 3/2008 | Mizrahi | |
| 2008/0161734 | A1 | 7/2008 | Blockton | |
| 2009/0030354 | A1 | 1/2009 | Ghatge | |
| 2009/0149899 | A1 | 6/2009 | Ahn | |
| 2010/0094184 | A1 * | 4/2010 | Wong et al. | 601/149 |
| 2011/0089725 | A1 | 4/2011 | Shantha et al. | |
| 2011/0166480 | A1 | 7/2011 | Mayer | |
| 2013/0041298 | A1 * | 2/2013 | Mayer et al. | 601/29 |

FOREIGN PATENT DOCUMENTS

| | | |
|---|---|---|
| EP | 1509101 | 3/2005 |
| JP | 2002325819 | 11/2002 |
| JP | 2004-526477 | 9/2004 |
| JP | 2006-521879 | 9/2006 |
| WO | 2005013743 | 2/2005 |
| WO | 2009152544 | 12/2009 |
| WO | WO 2011109725 | 9/2011 |

OTHER PUBLICATIONS

International Preliminary Report on Patentability dated Feb. 18, 2014 for PCT/US2012/050290.
Office Action dated May 15, 2013 for U.S. Appl. No. 13/040,982.
European Search Report dated May 3, 2012 for PCT/US2009049910.
Office Action dated May 2, 2012 for MX/a/2011/000246.
Preliminary Report on Patentability dated Jun. 12, 2014 for PCT/US2012/067365.
Australian Patent Examination Report No. 1 dated May 13, 2014 for 2009268641.
International Search Report and Written Opinion for PCT/US12/67365 dated Feb. 15, 2013.
Office Action dated Mar. 5, 2013 for European Patent Application No. 09795105.7-1658.
International Search Report dated Oct. 26, 2012 re: PCT/US2012/050290.
International Search Report dated Nov. 15, 2011 for PCT/US2009/049910.
International Search Report dated Nov. 22, 2011 for PCT/US2011/027220.
Office Action dated Feb. 7, 2012 for U.S. Appl. No. 13/004,754.
Notice of Allowance dated Dec. 15, 2010 for U.S. Appl. No. 12/499,473.
Notice of Allowance dated Nov. 5, 2010 for U.S. Appl. No. 12/499,473.
Information Disclosure Statement Dated Nov. 7, 2010 for U.S. Appl. No. 12/499,473.
Final Office Action dated Jun. 22, 2010 for U.S. Appl. No. 12/499,473.
Non-Final Office Action dated Apr. 15, 2010 for U.S. Appl. No. 12/499,473.
Office Action dated Jun. 9, 2013 in Chinese Patent Application No. 200980132527.7.
International Preliminary Report dated Sep. 11, 2012 for PCT/US2011/027220.
Non-Final Office Action dated Sep. 21, 2011 for U.S. Appl. No. 13/004,754.
Office Action dated Jul. 24, 2014 for Chinese Patent Application No. 200980132527.7.
Examination Report dated Aug. 5, 2014 for European Patent Application No. 09795105.7.
Examination Report dated Sep. 8, 2015 for European Patent Application No. 09795105.7.
Non-Final Office Action dated Sep. 10, 2015 for U.S. Appl. No. 13/554,834.
Office Action dated Aug. 25, 2015 for Chinese Patent Application No. 201280068673.X.
Restriction Requirement dated Oct. 7, 2015 for U.S. Appl. No. 14/178,554.
Office Action dated Aug. 28, 2015 for Canadian Patent Application No. 2730238.
Examination Report dated Nov. 6, 2015 for Australian Patent Application No. 2009268641.
Notice of Allowance dated Apr. 12, 2012 for U.S. Appl. No. 13/004,754.
Office Action dated Sep. 8, 2012 for Mexican Patent Application No. Mx/a/2011/000246.
Final Office Action dated Mar. 12, 2014 for U.S. Appl. No. 13/040,982.
Examination Report dated Feb. 9, 2015 for European Patent Application No. 09795105.7.
Examiner's Interview dated Mar. 20, 2012 for U.S. Appl. No. 13/004,754.
Examination Report dated Mar. 26, 2015 for Australian Patent Application No. 200926641.
Notice of Allowance dated Aug. 28, 2013 for Mexican Patent Application No. Mx/a/2011/000246.

(56) References Cited

OTHER PUBLICATIONS

Restriction Requirement dated May 19, 2015 for U.S. Appl. No. 13/554,834.

European Search Report and Opinion dated Jun. 15, 2015 for European Patent Application No. 12853699.2.

Examination Report dated Aug. 19, 2015 for Australian Patent Application No. 2009268641.

* cited by examiner

TREATMENT AND/OR PREVENTION OF MEDICAL CONDITIONS VIA COMPRESSION

CROSS-REFERENCE TO RELATED APPLICATIONS

This application is a continuation-in-part of U.S. Ser. No. 13/004,754 filed on Jan. 11, 2011 entitled "FOOT COMPRESSION SYSTEM." U.S. Ser. No. 13/004,754 is a continuation-in-part of U.S. Ser. No. 12/499,473, now U.S. Pat. No. 7,909,783 issued Mar. 22, 2011 entitled "FOOT COMPRESSION SYSTEM." U.S. Ser. No. 12/499,473 is a non-provisional of U.S. Provisional Patent Application No. 61/078,847 filed on Jul. 8, 2008 and entitled "FOOT COMPRESSION SYSTEM." The entire contents of all the foregoing applications are hereby incorporated by reference.

TECHNICAL FIELD

The present disclosure generally relates to medical care, and specifically to systems and methods for compressing a portion of a human body to treat and/or prevent a medical condition.

BACKGROUND

In order to enhance circulation in a person's body, particularly in the feet and legs, periodic or cyclic compression of tissue, such as plexus regions of the foot, at predetermined timed intervals is beneficial. Under normal circumstances, blood moves up the legs due to muscle contraction and general movement of the feet or legs, such as when walking. If a person is immobilized, unable to move regularly, or has poor circulation brought on by disease, the natural blood return mechanism is impaired, and circulatory problems such as ulcers and deep vein thrombosis can occur.

To mitigate these problems, it is desirable to concentrate a compression force against veins throughout the legs and/or feet. Current systems are primarily based on pneumatic compression devices that squeeze the entire foot, calf, or thigh. These systems require significant power, and are inefficient because they provide high levels of force across the entire foot or leg rather than focusing in on those areas with the highest concentration of blood vessels. In addition, these systems may include air bags that can rupture at the seam, especially with high pressure within the bag.

In various current devices, tethered air lines limit mobility, and can lead to injury should the person attempt to walk while the device is in use. Further, existing devices may not be suited for continuous usage. Users cannot walk with them, or move away from the compression unit. The device must be removed before a user can walk. Additionally, current devices lack the ability to track and report user usage and compliance. Also, most pneumatic devices are quite noisy and can cause irritation of the skin leading to ulcers.

SUMMARY

A compression system is configured to apply pressure to a portion of a human body. In an exemplary embodiment, a system and/or method of the present disclosure are used to treat or prevent a medical condition such as plantar fasciitis, restless leg syndrome, deep vein thrombosis, pulmonary embolism, venous insufficiency, and wound care, by a method comprising moving, by a compression system, a pressure pad a first time to bring the pressure pad into contact with a portion of a human body to compress the portion of the human body; moving, by the compression system, the pressure pad a second time to bring the pressure pad out of contact with the portion of a human body to allow the portion of the human body to at least partially refill with blood; and moving, by the compression system, the pressure pad a third time to bring the pressure pad into contact with the portion of the human body to compress the portion of the human body.

BRIEF DESCRIPTION OF THE DRAWINGS

The subject matter of the present disclosure is particularly pointed out and distinctly claimed in the concluding portion of the specification. The present disclosure, however, both as to organization and method of operation, may best be understood by reference to the following description taken in conjunction with the claims and the accompanying drawing figures, in which like parts may be referred to by like numerals:

DETAILED DESCRIPTION

Details of the present disclosure may be described herein in terms of various components and processing steps. It should be appreciated that such components and steps may be realized by any number of hardware and/or software components configured to perform the specified functions. For example, a foot compression system may employ various medical treatment devices, input and/or output elements and the like, which may carry out a variety of functions under the control of one or more control systems or other control devices. In addition, details of the present disclosure may be practiced in any number of medical or treatment contexts, and exemplary embodiments relating to a deep vein thrombosis treatment system and/or method, a plantar fasciitis treatment system and/or method, a pulmonary embolism prevention system and/or method, or a restless leg treatment system and/or method as described herein are merely a few of the exemplary applications. For example, the principles, features and methods discussed may be applied to any suitable medical or other tissue or treatment application.

Figure 1:
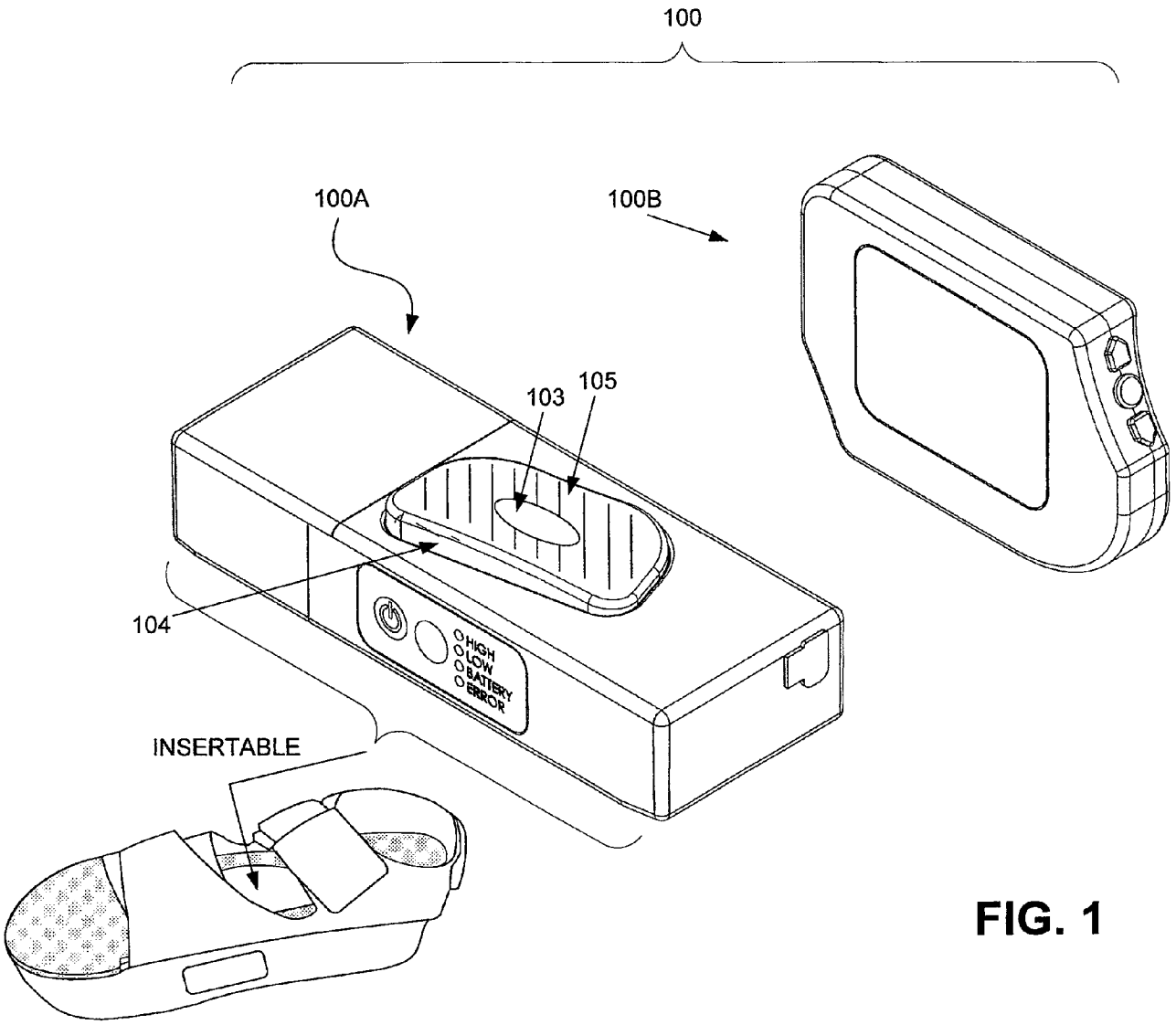
FIG. 1 illustrates a foot compression system in accordance with an exemplary embodiment.

A foot compression system may be any system configured to deliver a compressive force to a portion of a living organism, for example a human foot or leg. With reference now to FIG. 1, and in accordance with an exemplary embodiment, a foot compression system 100 comprises actuator portion 100A and reader portion 100B. Actuator portion 100A is configured to deliver a compressive force to a foot responsive to communication with reader portion 100B. Moreover, a foot compression system may be configured with any appropriate components and/or elements configured to deliver a compressive force to a portion of a living organism.

With further reference now to FIGS. 2A-2B, 3, and 4A-4C, and in accordance with an exemplary embodiment, actuator portion 100A comprises main housing 102, pressure pad 104, pad top 105, motor 106, gearbox 108, output gears 110, main gears 112, slip clutch 116, electrical components 118, and weight sensor 120. Reader portion 100B comprises control box 130, batteries 132 (not shown in figures), display 134, and inputs 136.

Actuator portion 100A may be any device, system, or structure configured to apply a compressive force to a foot. In an exemplary embodiment, actuator portion 100A is configured to be removably located in the sole area of an item of footwear such as a shoe, sandal, or any other type of footwear product. In other exemplary embodiments, actuator portion 100A may be integrated into an item of footwear. Actuator portion 100A may also be a stand-alone unit, for example a footrest.

In various exemplary embodiments, actuator portion 100A has an outer shape at least partially defined by a main housing 102. Main housing 102 may be formed of metal, plastic, composite, or other suitable durable material. Main housing 102 is configured to enclose various portions of foot compression system 100.

Figure 2A:
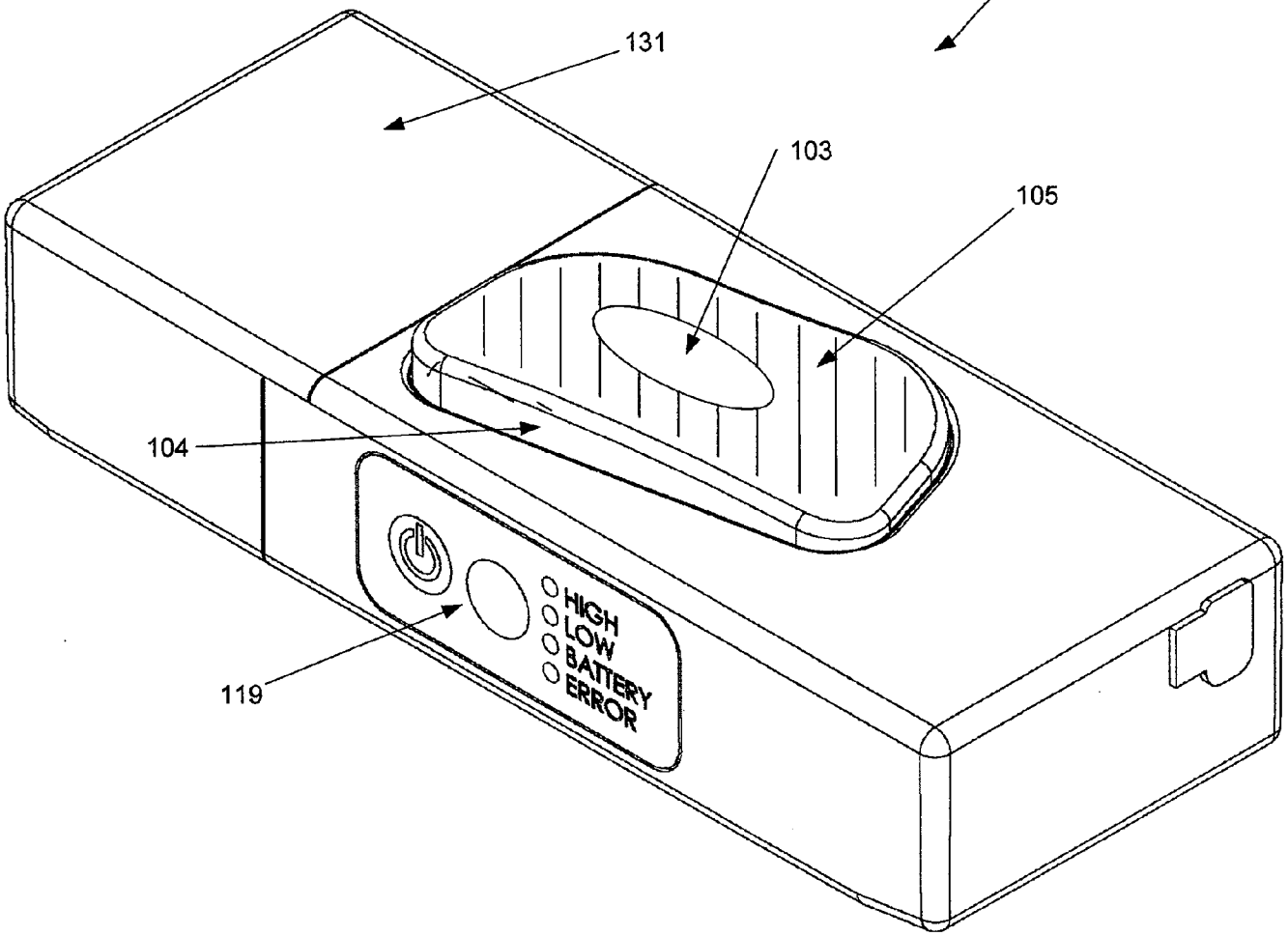
FIG. 2A illustrates an actuator portion of a foot compression system in accordance with an exemplary embodiment.
Figure 2B:
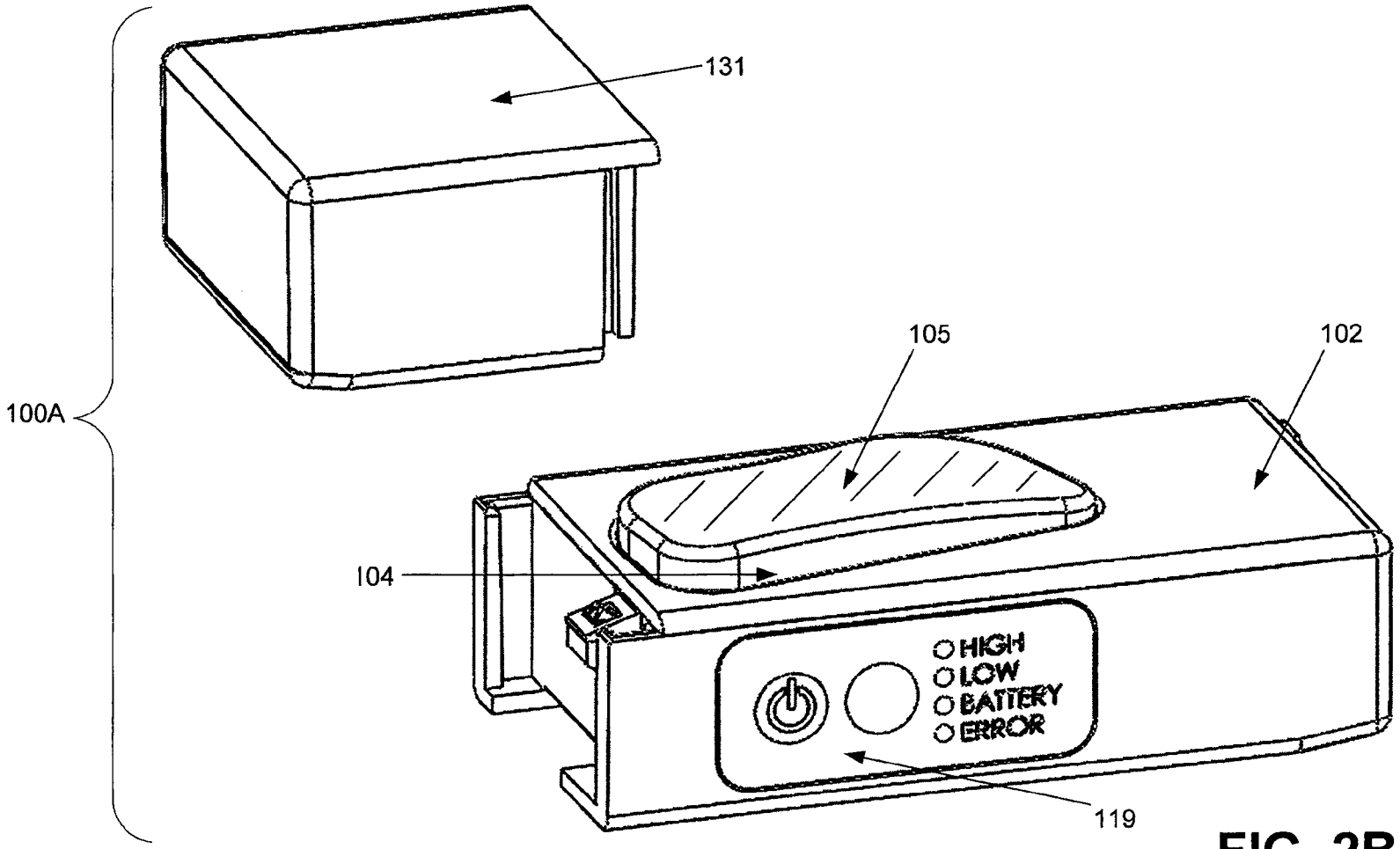
FIG. 2B illustrates an actuator portion of a foot compression system with a battery detached in accordance with an exemplary embodiment.
Figure 3:
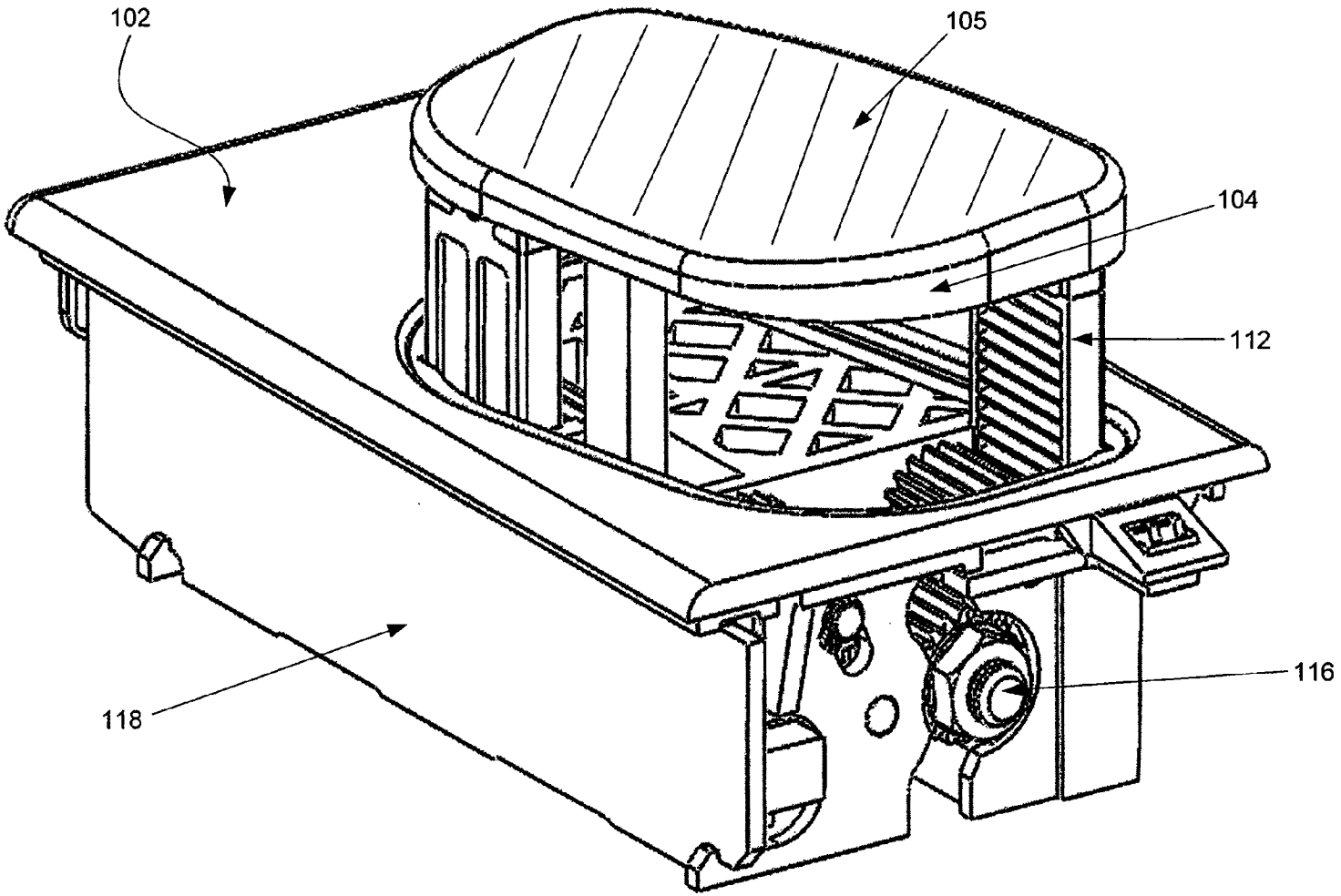
FIG. 3 illustrates various components of an actuator portion of a foot compression system in accordance with an exemplary embodiment.

Turning now to FIGS. 2A through 3, and in accordance with an exemplary embodiment, pressure pad 104 comprises a rigid or semi-rigid structure configured to press against a person's foot. In various exemplary embodiments, pressure pad 104 is extendable and retractable. Moreover, pressure pad 104 may be rigid, semi-rigid and/or non-bendable. Pressure pad 104 is coupled to main gears 112. Moreover, pressure pad 104 may be configured to be moved by and/or coupled to any suitable power transfer components.

Pressure pad 104 may be made of any suitable materials, for example metal, plastic, composite, and/or the like. Moreover, pressure pad 104 may be comprised of any material suitable for transferring force to a person's foot. Pressure pad 104 may be monolithic. Alternatively, pressure pad 104 may comprise two or more individual components. In certain exemplary embodiments, pressure pad 104 comprises a rigid main structure configured with a flexible pad top 105, for example a pad top 105 comprised of rubber, silicone, or other suitable material. Pad top 105 may be smooth, ridged, dimpled, patterned, and/or otherwise shaped and/or textured. In this manner, pressure pad 104 may be configured to press against a person's foot while providing a desired level of cushioning, comfort, friction, and/or the like, for example due to pad top 105.

Pressure pad 104 can be any size to transfer force to a person's foot. According to an exemplary embodiment, pressure pad 104 applies force directly to the arch region of the foot. In various exemplary embodiments, pressure pad 104 comprises a contact surface area in the range of about 6 square centimeters to about 30 square centimeters. In various exemplary embodiments, pressure pad 104 comprises a contact surface area in the range of about 10 square centimeters to about 24 square centimeters. In other exemplary embodiments, pressure pad 104 comprises a contact surface area in the range of about 18 square centimeters to about 23 square centimeters. However, pressure pad 104 may be configured with any appropriate dimensions, surfaces, angles, and/or components, as desired, in order to transfer force to a foot. For example, in certain exemplary embodiments wherein foot compression system 100 is utilized in connection with athletic recovery, pressure pad 104 may be configured with a contact surface area substantially equal to the surface area of the bottom of a foot, for example a contact surface area in the range of between about 100 square centimeters to about 150 square centimeters. In various other exemplary embodiments wherein foot compression system 100 is utilized in connection with treatment of plantar fasciitis, treatment of deep vein thrombosis, treatment of restless leg syndrome, and/or wound care, pressure pad 104 may be configured with a contact area in the range of about 6 square centimeters to about 150 square centimeters, as desired.

In various exemplary embodiments, pressure pad 104 further comprises a pressure sensor 103 configured to measure the pressure generated by pressure pad 104. The pressure sensor may communicate with control electronics 118 and/or other components of foot compression system 100 in order to achieve a desired level of pressure generated by pressure pad 104.

In an exemplary embodiment, when extended away from main housing 102, pressure pad 104 presses against the venous plexus region of the foot. Pressure pad 104 compresses the veins both in the arch of the foot and across the top of the foot from approximately the metatarsal-phalangeal joints to the talus. In various exemplary embodiments, pressure pad 104 is pressed against the venous plexus region of the foot for a time between approximately 1 and 5 seconds. In another exemplary embodiment, pressure pad 104 is pressed against the venous plexus region of the foot for approximately 2 seconds. Moreover, pressure pad 104 may be pressed against the venous plexus region for the foot for any suitable time to stimulate blood flow.

In an exemplary embodiment, pressure pad 104 is configured to extend and/or retract over a desired time period. In various exemplary embodiments, pressure pad 104 is configured to extend from a fully retracted position to a fully extended position in a time between about 100 milliseconds and about 300 milliseconds. Moreover, pressure pad 104 may be configured to extend and/or retract over any suitable time period.

In an exemplary embodiment, pressure pad 104 retracts so that it is flush or nearly flush with an outer surface of main housing 102. Compression and relaxation is then followed by a period of non-compression to allow the veins within the venous plexus to re-fill with blood. In various exemplary embodiments, pressure pad 104 is pressed against the venous plexus region of the foot and then retracted in regular intervals of between about 20 seconds to about 45 seconds. In another exemplary embodiment, pressure pad 104 is pressed against the venous plexus region of the foot and then retracted in regular intervals of about 30 seconds. Further, pressure pad 104 may be pressed against the venous plexus region of the foot and then retracted in any suitable interval to stimulate blood flow. For example, compression may be rapid in order to move blood through the veins of the lower leg at an elevated velocity and to release chemical compounds that reduce pain.

In accordance with an exemplary embodiment, switches and/or other appropriate mechanisms may be located at the maximum and/or minimum extensions of pressure pad 104 in order to prevent motor 106 from attempting to force pressure pad 104 beyond the end of travel. Such switches or other travel-limiting devices may be implemented mechanically, in hardware, in software, or any combination of the foregoing.

Figure 4A:
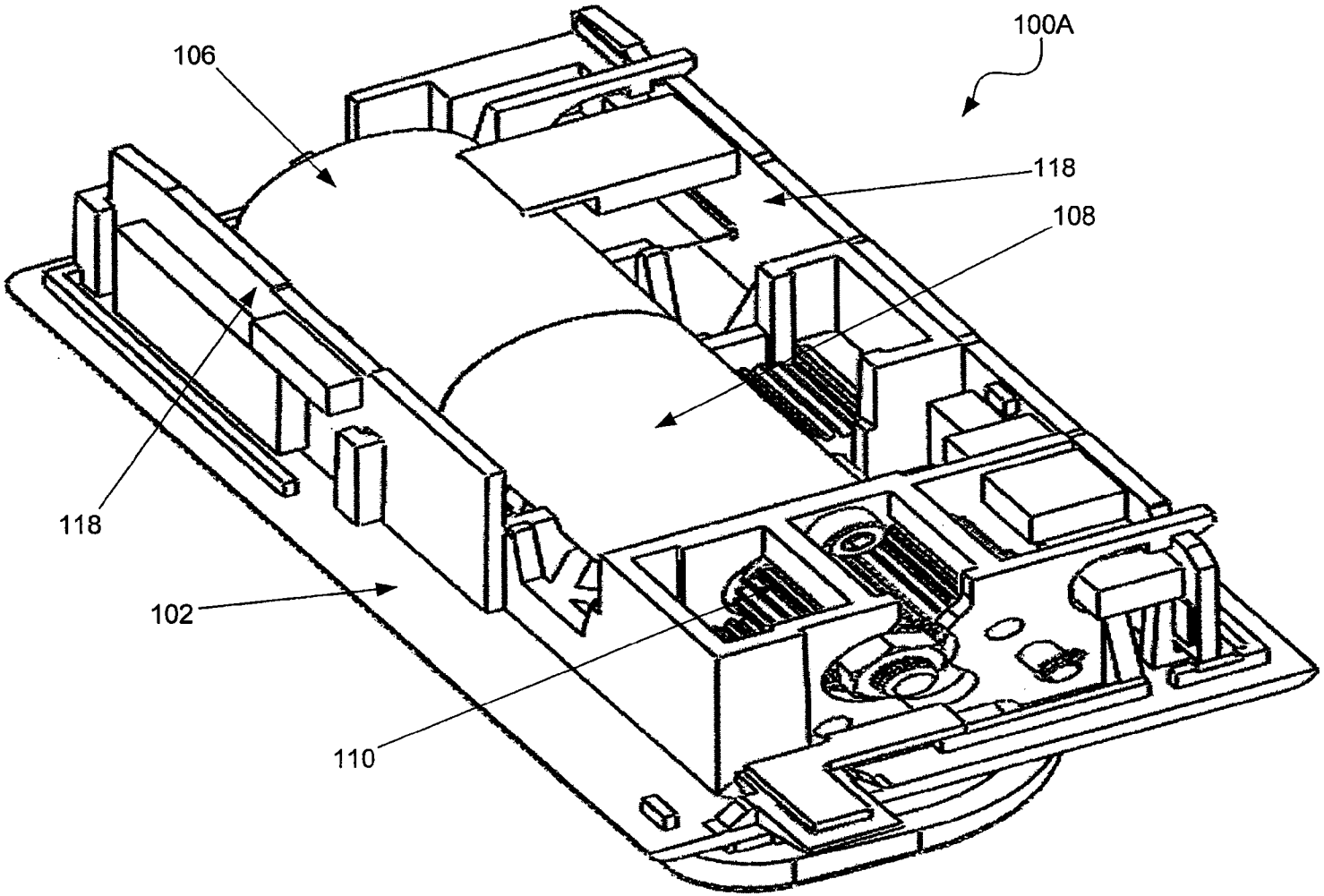
FIGS. 4A through 4C illustrate various components of an actuator portion of a foot compression system in accordance with an exemplary embodiment.
Figure 4B:
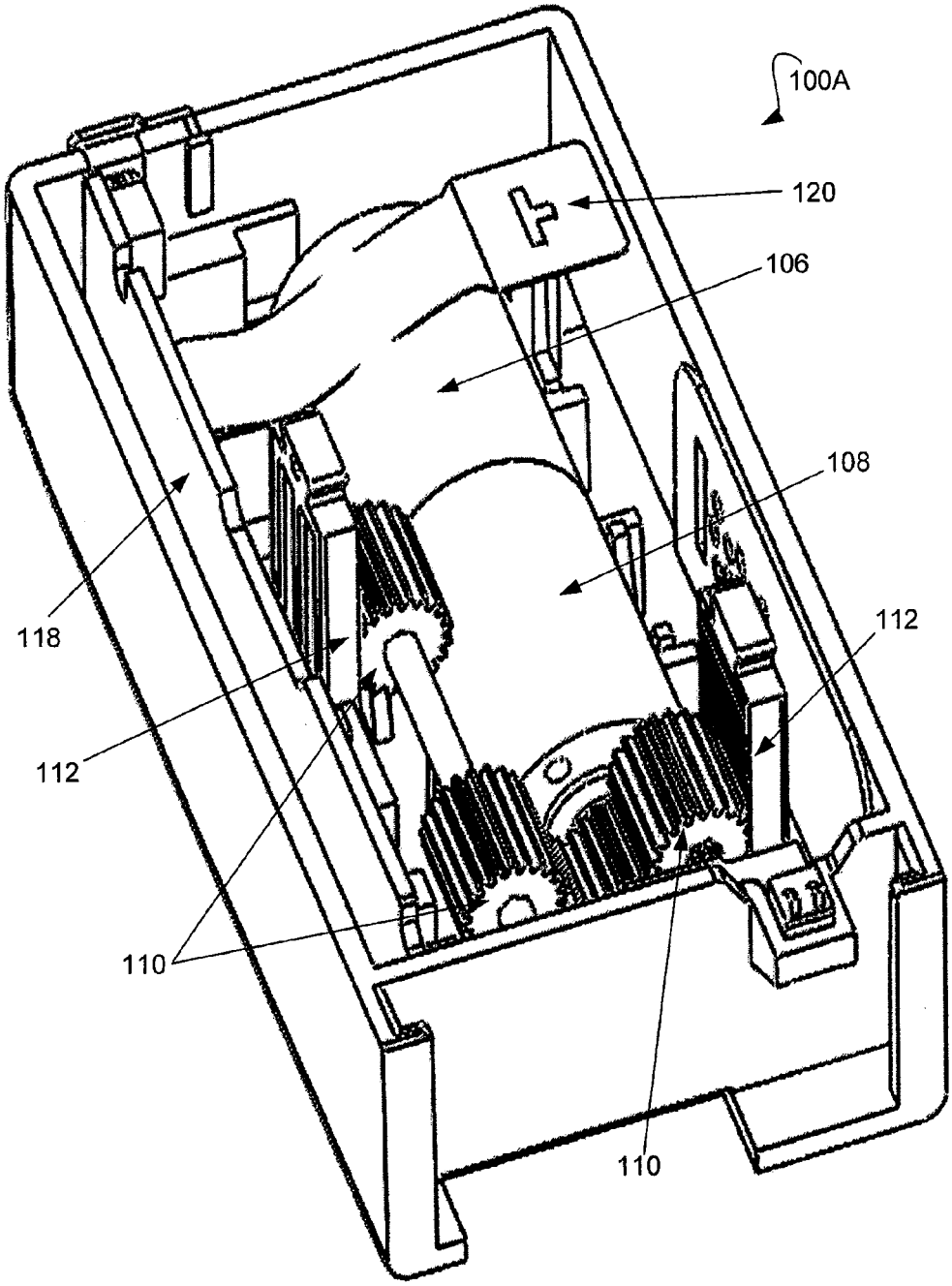
Figure 4C:
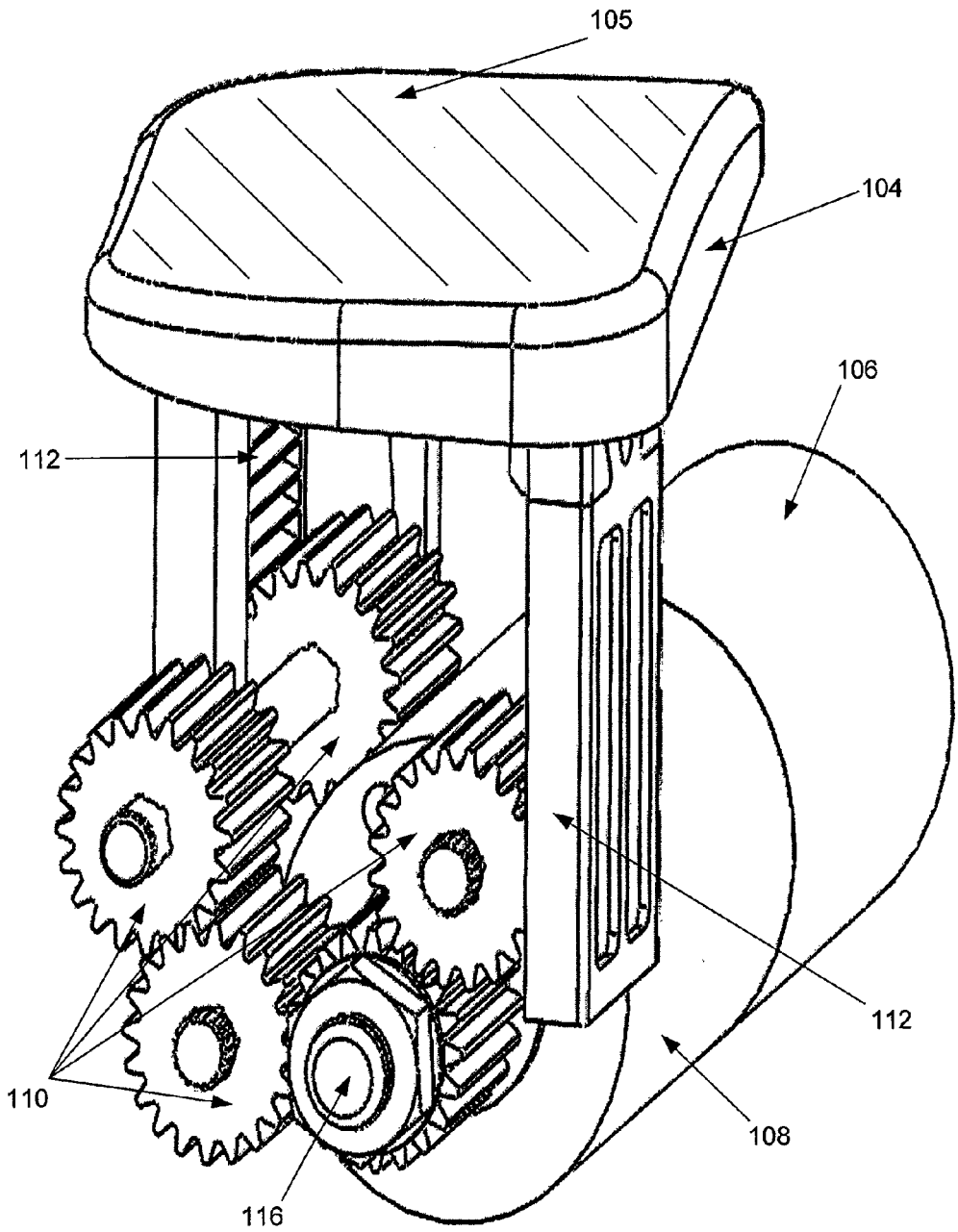

Motor 106 may be any component configured to generate mechanical force to move pressure pad 104. With reference now to FIGS. 4A through 4C, and in accordance with an exemplary embodiment, motor 106 comprises a rotary output shaft driving a pinion. Motor 106 may comprise any suitable motor, such as a brushless direct current (DC) motor, a brushed DC motor, a coreless DC motor, a linear DC motor, and/or the like. Moreover, any motor, actuator, micro-engine, or similar device presently known or adopted in the future to drive moving parts within foot compression system 100 falls within the scope of the present disclosure. In various other exemplary embodiments, motor 106 may be replaced with another suitable power generation mechanism capable of moving pressure pad 104, such as an artificial muscle, a piezoelectric material, a shape memory alloy, and/or the like. Motor 106 is coupled to gearbox 108.

With continued reference to FIGS. 4A through 4C, and in accordance with an exemplary embodiment, gearbox 108 comprises a mechanism configured to increase the mechanical advantage obtained by motor 106, for example a reduction gearbox. Gearbox 108 is coupled to motor 106 and to output gears 110. Output force from motor 106 is transferred through gearbox 108 in order to achieve an appropriate gear ratio for effectuating movement of pressure pad 104. Thus, gearbox 108 may have a fixed gear ratio. Alternatively, gearbox 108 may have a variable or adjustable gear ratio. Gearbox 108 may comprise any suitable ratio configured in any suitable matter to effectuate movement of pressure pad 104. Moreover, gearbox 108 may comprise any suitable components, configurations, ratios, mechanisms, and/or the like, as desired, in order to transfer output force from motor 106 to other components of foot compression system 100, for example output gears 110.

Output gears 110 may comprise any mechanism configured to transfer force from gearbox 108 to main gears 112. Continuing to reference FIGS. 4A through 4C, in accordance with an exemplary embodiment, output gears 110 comprise metal, plastic, or other durable material. Output gears 110 are coupled to gearbox 108 and to main gears 112. Output force from motor 106 is transferred through gearbox 108 to output gears 110. Output gears 110 are further configured to interface with main gears 112. Moreover, output gears 110 may comprise any composition or configuration suitable to transfer force to main gear 112.

Main gears 112 may comprise any suitable component or structure configured to effectuate movement of pressure pad 104. As illustrated in FIGS. 4A through 4C, in an exemplary embodiment, one or more main gears 112 are coupled to pressure pad 104. Main gears 112 interface with output gear 110. As main gears 112 move in response to force transferred by output gears 110, pressure pad 104 is extended and/or retracted through its range of motion. In various exemplary embodiments, main gears 112 are configured to effectuate movement of pressure pad 104 a distance of between about 1 mm to about 24 mm from a fully retracted to a fully extended position. In various other exemplary embodiments, main gears 112 are configured to effectuate movement of pressure pad 104 a distance of between about 12 mm to about 24 mm from a fully retracted to a fully extended position. Moreover, movement of pressure pad 104 may vary based on an individual user. For example, pressure pad 104 may be extended a larger distance for a user having a higher foot arch, and a smaller distance for a user having a lower foot arch. Additionally, pressure pad 104 may be moved between a fully retracted and a partially extended position, for example if a desired pressure value is reached via partial extension of pressure pad 104. Pressure pad 104 may also move responsive to operation of slip clutch 116.

With reference to FIGS. 4A through 4C, slip clutch 116 may comprise any mechanism configured to prevent damage to motor 106 and/or injury to a person. For example, if a person applies excessive force or weight to their foot when pressure pad 104 is extended, slip clutch 116 allows pressure pad 104 to safely retract back towards main housing 102. In an exemplary embodiment, slip clutch 116 is a friction clutch. Slip clutch 116 is configured to slip when excessive force is placed on pressure pad 104. In various exemplary embodiments, slip clutch 116 is configured to slip when the force on pressure pad 104 exceeds between about 130 Newtons to about 200 Newtons. In another exemplary embodiment, slip clutch 116 is configured to slip when the force on pressure pad 104 exceeds 155 Newtons. Moreover, slip clutch 116 may be configured to slip responsive to any suitable force in order to prevent damage to motor 106 or other components of foot compression system 100 and/or injury to a person.

In various exemplary embodiments, foot compression system 100 may be at least partially operated, controlled, and/or activated by one or more electronic circuits, for example control electronics 118. In accordance with an exemplary embodiment, control electronics 118 and/or an associated software subsystem comprise components configured to at least partially control operation of foot compression system 100. For example, control electronics 118 may comprise integrated circuits, discrete electrical components, printed circuit boards, and/or the like, and/or combinations of the same. Control electronics 118 may further comprise clocks or other timing circuitry. Control electronics 118 may also comprise data logging circuitry, for example volatile or non-volatile memories and the like, to store data, such as data regarding operation and functioning of foot compression system 100. Moreover, a software subsystem may be pre-programmed and communicate with control electronics 118 in order to adjust various variables, for example the time that pressure pad 104 remains in an extended position, the pressure applied to the foot, intervals of travel between the extended and retracted positions of pressure pad 104, the time it takes for pressure pad 104 to extend to the extended position and retract to a recessed position, and/or the like.

Control electronics 118 may be configured to store data related to foot compression system 100. For example, in various exemplary embodiments, control electronics 118 may record if foot compression system 100 is mounted to the foot of a person and active, if foot compression system 100 is mounted to the foot of a person and inactive, if foot compression system 100 is not mounted to the foot of a person and system 100 is inactive, and/or the like and/or combinations of the same. Further, control electronics 118 may record the duration foot compression system 100 is active, the number of compression cycles performed, one or more pressures generated by foot compression system 100, and so forth. Moreover, control electronics 118 may further comprise circuitry configured to enable data stored in control electronics 118 to be retrieved for analysis, deleted, compacted, encrypted, and/or the like.

In accordance with an exemplary embodiment, when pressure pad 104 is being extended or is in a fully extended state, control electronics 118 may monitor the pressure applied by pressure pad 104. For example, control electronics 118 may monitor the current drawn by motor 106 and calculate the applied pressure. Alternatively, a pressure sensor may detect the applied pressure and report this value to control electronics 118 and/or an associated software subsystem.

In various exemplary embodiments, pressure pad 104 may be extended until a pressure threshold, such as between about 1 mmHg and 500 mmHg, is reached. In other exemplary embodiments, pressure pad 104 may be extended until a pressure threshold of between about 300 mmHg and 465 mmHg is reached. Alternatively, pressure pad 104 may be extended until pressure pad 104 is at the point of maximum extension from main housing 102. In various exemplary embodiments, pressure pad 104 is extended with a force of between approximately 50 Newtons and approximately 115 Newtons. In other exemplary embodiments, pressure pad 104 is extended with a force of between approximately 75 Newtons and approximately 100 Newtons. While various pressures and/or forces have been described herein, other pressures and/or forces can be applied and fall within the scope of the present disclosure. Moreover, switches and/or other devices may be placed at the locations of maximum and/or minimum extension of pressure pad 104 in order to ensure that motor 106 is appropriately shut off at the end of travel.

With reference to FIG. 4B, in accordance with an exemplary embodiment, weight sensor 120 is provided within main housing 102. Weight sensor 120 comprises any suitable sensor configured to detect weight applied to main housing 102. When weight sensor 120 detects a suitable amount of weight, such as 25 pounds or more, electronic controls 118 may infer that the person is walking or otherwise putting pressure on actuator portion 100A. Moreover, any appropriate weight may be utilized, and thus falls within the scope of the present disclosure. Accordingly, electronic controls 118 may implement a delay in activating foot compression system 100 to ensure the person does not walk on the raised pressure pad 104.

In various exemplary embodiments, actuator portion 100A may comprise various sensors, for example pressure sensors, weight sensors, strain gauges, accelerometers, and/or the like. Actuator portion 100A and/or reader portion 100B may utilize one or more sensors for monitoring and/or control of foot compression system 100. For example, in certain exemplary embodiments it may be desirable to prevent extension of pressure pad 104 when a person is walking or applying body weight to actuator portion 100A. Thus, electronic control 118 may prevent extension of pressure pad 104 and/or retract pressure pad 104, for example responsive to sensor input indicating a person is walking (e.g., accelerometer readings, weight sensor readings, and/or the like). In various exemplary embodiments, foot compression system 100 may be configured to be turned "on" when a user is seated and/or recumbent, and configured to be turned to a "standby" mode (e.g., a mode wherein pressure pad 104 remains retracted) when a user is standing and/or walking.

With reference now to FIGS. 2A and 2B, in an exemplary embodiment, actuator portion 100A may further comprise one or more indicators 119. Indicators 119 may comprise any components configured to receive input from a user and/or to deliver feedback to a user. For example, indicators 119 may comprise on/off buttons, lights, switches, and/or the like. In an exemplary embodiment, indicators 119 comprise a power button, a "high" foot compression setting light, a "low" foot compression setting light, a battery level warning light, and an error message light. Moreover, indicators 119 may comprise any suitable input and/or output components, as desired.

With continued reference to FIGS. 2A and 2B, in accordance with an exemplary embodiment, actuator portion 100A further comprises a removable battery 131. Battery 131 may comprise electrochemical cells suitable to provide power for actuator portion 100A. Battery 131 may be rechargeable, but may also be single-use. Batteries 131 may comprise alkaline, nickel-metal hydride, lithium-ion, lithium-polymer, and/or other battery configurations suitable for powering actuator portion 100A. Moreover, battery 131 may comprise any suitable chemistry, form factor, voltage, and/or capacity suitable to provide power to actuator portion 100A. As illustrated, battery 131 may be decoupled from main body 102, for example to facilitate recharging of battery 131, as desired.

In various exemplary embodiments, foot compression system 100 may further comprise a motion sensor, accelerometer, or other components configured to detect movement of foot compression system 100. Control electronics 118 may prevent operation of actuator portion 100A unless the motion sensor reports actuator portion 100A (and thus, typically, the limb to which actuator portion 100A is mounted) has been substantially motionless for a period of time, such as between about 2 minutes and 10 minutes. Further, any appropriate time range is considered to fall within the scope of the present disclosure, as the ranges set forth herein are exemplary only.

Figure 5:
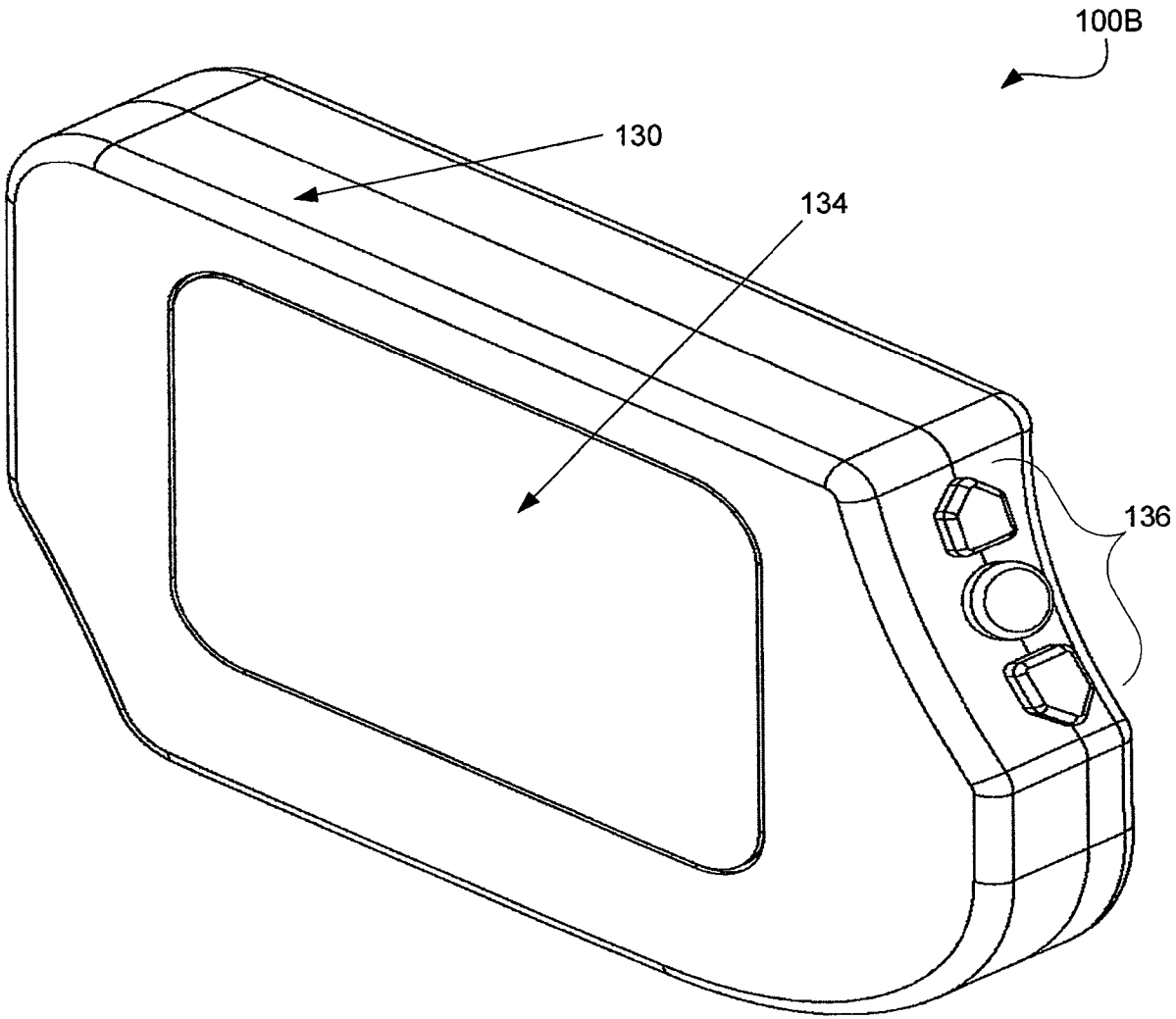
FIG. 5 illustrates a reader portion of a foot compression system in accordance with an exemplary embodiment.

With reference now to FIGS. 1 and 5, and in accordance with an exemplary embodiment, foot compression system 100 comprises a reader portion 100B configured to facilitate communication with and/or control of actuator portion 100A and/or other components of foot compression system 100. Reader portion 100B may comprise any suitable components, circuitry, displays, indicators, and/or the like, as desired.

For example, in an exemplary embodiment, reader portion 100B is used to control and program foot compression system 100. Reader portion 100B may be configured with a control box 130 comprising metal, plastic, composite, or other durable material suitable to contain various components of reader portion 100B. In an exemplary embodiment, reader portion 100B is coupled to actuator portion 100A via a cable, for example an electrical cable suitable to carry current to drive motor 106, carry digital signals, carry analog signals, and/or the like. In other exemplary embodiments, reader portion 100B and actuator portion 100A communicate wirelessly, for example via a suitable communication protocol (e.g., IEEE 802.15.4; Bluetooth™; IEEE 802.11, IEEE 1451, ISA 100.11a; and/or the like). In these embodiments, reader portion 100B and actuator portion 100A may further comprise transceivers, receivers, transmitters and/or similar wireless technology.

In accordance with an exemplary embodiment, reader portion 100B may comprise one or more batteries 132 (not shown in figures). Batteries 132 may comprise electrochemical cells suitable to provide power for reader portion 100B. Batteries 132 may be rechargeable, but may also be single-use. Batteries 132 may comprise alkaline, nickel-metal hydride, lithium-ion, lithium-polymer, or other battery configurations suitable for powering reader portion 100B. Moreover, batteries 132 may comprise any suitable chemistry, form factor, voltage, and/or capacity suitable to provide power to reader portion 100B.

Batteries 132 may be recharged via an external charger. Batteries 132 may also be recharged by use of electronic components within reader portion 100B. Alternatively, batteries 132 may be removed from reader portion 100B and replaced with fresh batteries.

With reference now to FIG. 5, and in accordance with an exemplary embodiment, reader portion 100*b* further comprises a display 134 configured for presenting information to a user. In an exemplary embodiment, display 134 comprises a liquid crystal display (LCD). In other exemplary embodiments, display 134 comprises light emitting diodes (LEDs). In still other exemplary embodiments, display 134 comprises visual and audio communication devices such as speakers, alarms, and/or other similar monitoring and/or feedback components. Moreover, display 134 may also comprise audible or tactile feedback components. Display 134 is configured to provide feedback to a system user. Moreover, display 134 may comprise any suitable components configured to provide information to a system user.

With continued reference to FIG. 5, inputs 136 may comprise any components configured to allow a user to control operation of foot compression system 100. In an exemplary embodiment, inputs 136 allow a user to turn foot compression system 100 on and off. Inputs 136 may also allow a user to adjust operating parameters of foot compression system 100, for example the interval of extension of pressure pad 104, the force with which pressure pad 104 is extended, the maximum pressure applied by pressure pad 104, various time intervals to have pressure pad 104 in an extended or retracted position, and/or the like. Further, inputs 136 may allow retrieval of data, such as system usage records. Data may be stored in actuator portion 100A, for example in control electronics 118, as well as in reader portion 100B, as desired.

In an exemplary embodiment, inputs 136 comprise electronic buttons, switches, or similar devices. In other exemplary embodiments, inputs 136 comprise a communications port, for example a Universal Serial Bus (USB) port. Further, inputs 136 may comprise variable pressure control switches with corresponding indicator lights. Inputs 136 may also comprise variable speed control switches with corresponding indicator lights, on/off switches, pressure switches, click wheels, trackballs, d-pads, and/or the like. Moreover, inputs 136 may comprise any suitable components configured to allow a user to control operation of foot compression system 100.

In accordance with an exemplary embodiment, foot compression system 100 is configured to be inserted into normal, off-the-shelf shoes, sandals, and other footwear. In various exemplary embodiments, pressure pad 104 is moved from the fully retracted position to the fully extended position in a time between about one-tenth (0.1) second and 1 second. In other exemplary embodiments, pressure pad 104 moves from the fully retracted position to the fully extended position in a time between about one-tenth (0.1) seconds and about three-tenths (0.3) seconds. Moreover, variances in individual feet (e.g., height of arch, curvature of arch, width, length, and/or the like) may effect the time period over which pressure pad is deployed.

In accordance with an exemplary embodiment, when moved to the fully extended position, pressure pad 104 may generate a pressure between about 1 mmHg and 500 mmHg against the person's foot. Further, pressure pad 104 may be extended with a force between about 50 Newtons and 115 Newtons in certain exemplary embodiments. Pressure pad 104 may be'kept in an extended position for a time between about 1 and 3 seconds. Pressure pad 104 is then retracted. Pressure pad 104 may then be re-extended, such as after a delay of between about 20 and 45 seconds. However, other time frames can be used, and all time frames are thought to fall within the scope of the present disclosure.

While specific time ranges, sizes, pressures, movement distances, and the like have been described herein, these values are given purely for example. Various other time ranges, sizes, pressures, distances, and the like can be used and fall within the scope of the present disclosure. Any device configured to apply pressure to a person's foot as set forth herein is considered to fall within the scope of the present disclosure.

In certain exemplary embodiments, foot compression system 100 is configured for use in, complementary to, and/or as a substitute for low-intensity physical exertion after a workout. Stated another way, foot compression system 100 is configured to facilitate "athletic recovery," or the augmentation of blood flow in the body's venous system to deliver nutrients to the muscles while simultaneously removing lactic acid and metabolic waste. After a workout, it has been found that a person may recover more quickly from the aftereffects of exercise (for example, accumulation of lactates in the muscle and/or blood) via low-intensity physical exertion rather than via complete rest. The increased blood circulation attendant to low-intensity physical exertion facilitates the removal of lactic acid from muscle and the reduction of lactate levels in the bloodstream. Additionally, physical exertion can facilitate facilitating opening the capillary bed to enable remedial hydration and/or efficient nutrient transfer. In contrast, post-workout periods of immobility, for example either sitting or recumbent, do little physiologically to promote athletic recovery. Lowered venous peak velocity closes the capillaries and locks lactic acid in place, which influences swelling and muscle soreness. Moreover, sitting with hips and knees in flexion, with bends of 60 to 90 degrees in the knees and hips, can kink the arterial blood supply and venous return, elevating the risk of edema stasis, toxin storage, and nutrient deficiency.

Therefore, by promoting blood circulation, foot compression system 100 may be utilized to achieve similar benefits as those obtained via low-intensity physical exertion. For example, foot compression system 100 may be utilized to achieve augmentation of peak venous velocity, augmentation of venous volume return, and/or augmentation of fibrinolysis. Additionally, the increased venous outflow evacuates cellular waste byproducts and reduces excess fluid trapped in the soft tissues of the lower leg, thereby promoting arterial inflow to the vacated capillary bed. Lower leg edema and other significant risk factors are reduced and/or eliminated. Stated another way, via use of foot compression system 100, a person may achieve similar results as those achieved via low aerobic activity (for example, a normal walking pace) but without walking. The user achieves augmented venous outflow despite being in a seated and/or recumbent position.

In an exemplary embodiment, foot compression system 100 may be used by a person as part of a "cool down" process during the "golden hour"—the first 60 minutes immediately after a workout. In other exemplary embodiments, foot compression system 100 may be used during a predetermined period after a workout, for example between immediately after a workout to about 12 hours after a workout. Foot compression system 100 may be utilized after a workout for a suitable duration, for example a duration of between about 10 minutes to about 2 hours, in order to assist in athletic recovery. While residual cellular metabolic waste can take several days to flush from the soft tissues, this process can be greatly accelerated via use of foot compression system 100 after a workout. To facilitate use of foot compression system 100 as part of an athletic recovery program, foot compression system 100 or components thereof may be integrated into athletic footwear intended for use during a workout. Moreover, foot compression system 100 or components thereof may also be integrated into specialized post-exercise footwear.

Moreover, foot compression system 100 may be utilized on a regular schedule by a person, for example as part of a pre-workout warmup, a post-workout cooldown, and/or on days when no workout is scheduled. By increasing blood flow, foot compression system 100 can facilitate improved muscle readiness prior to exercise, quicker post-exercise recovery, and/or improved circulation on days absent strenuous exercise. In particular, foot compression system 100 may be desirably utilized by athletes subsequent to athletic events in order to facilitate faster recovery.

In various exemplary embodiments, foot compression system 100 is configured for use in connection with treatment of and/or prevention of one or more medical conditions, for example plantar fasciitis, edema, deep vein thrombosis, pulmonary embolism, restless leg syndrome, venous insufficiency, and/or the like. Moreover, foot compression system 100 may be configured for use in connection with wound care.

In various exemplary embodiments, actuator portion 100A is contained within an item of footwear, for example a shoe. In one exemplary embodiment, actuator portion 100A is configured to repeatedly compress the venous plexus region of the foot as discussed herein. In this embodiment, actuator portion 100A may be utilized for extended post-workout athletic recovery.

In another exemplary embodiment, actuator portion 100A is configured to compress the venous plexus region of the foot only when the wearer of the footwear is not walking or applying weight to the footwear. In this embodiment, actuator portion 100A may be utilized for pre-workout warmup, post-workout cooldown, and/or the like, without the need for a change of footwear.

Figure 6B:
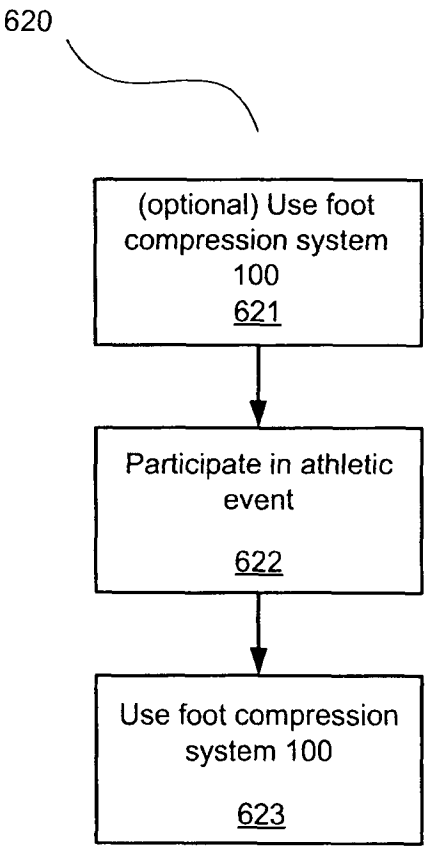
FIGS. 6A and 6B illustrate methods of using a foot compression system in accordance with various exemplary embodiments.
Figure 6A:
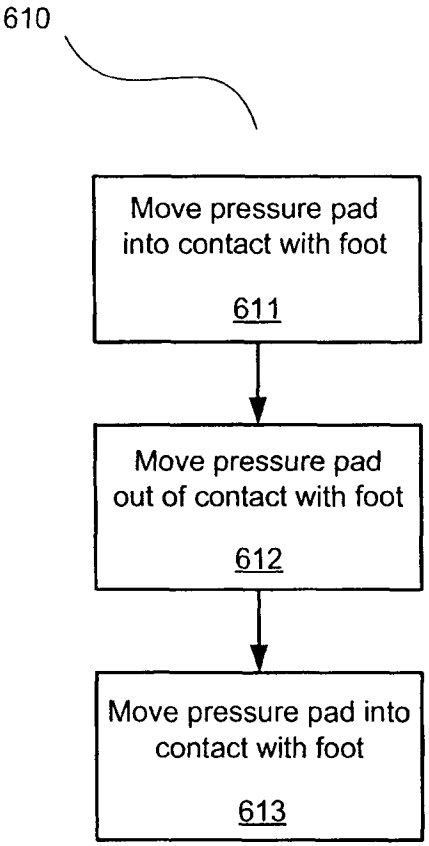
Figure 7A:
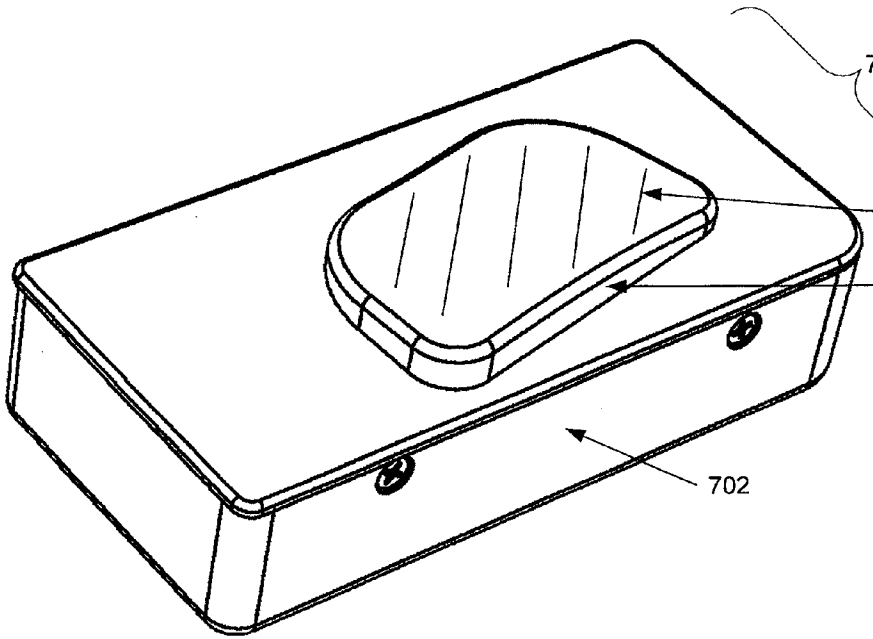
FIGS. 7A-7D illustrate a foot compression system in accordance with an exemplary embodiment.
Figure 7B:
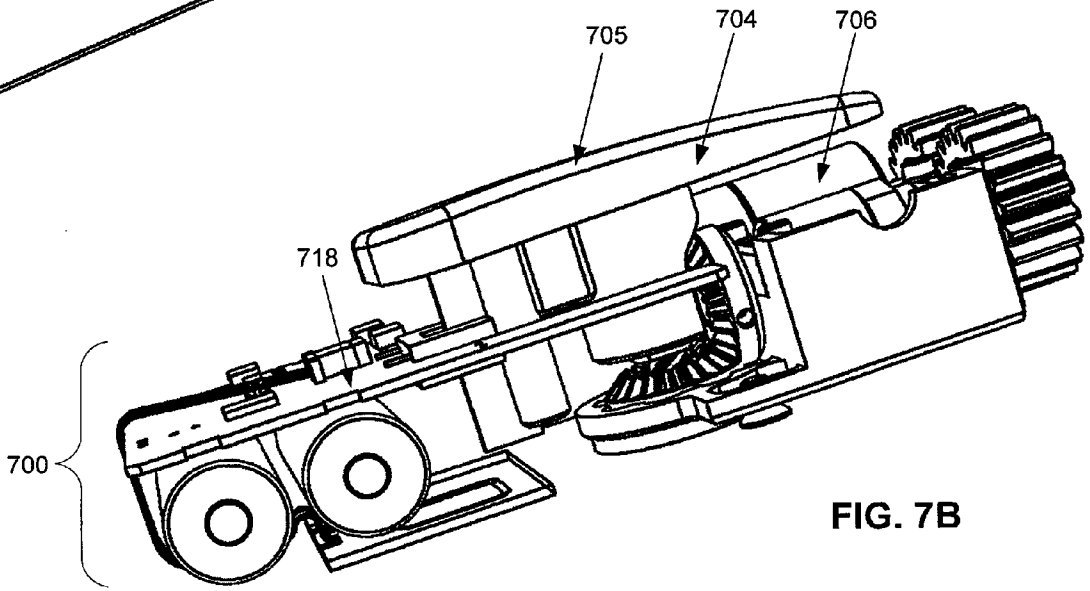
Figure 7C:
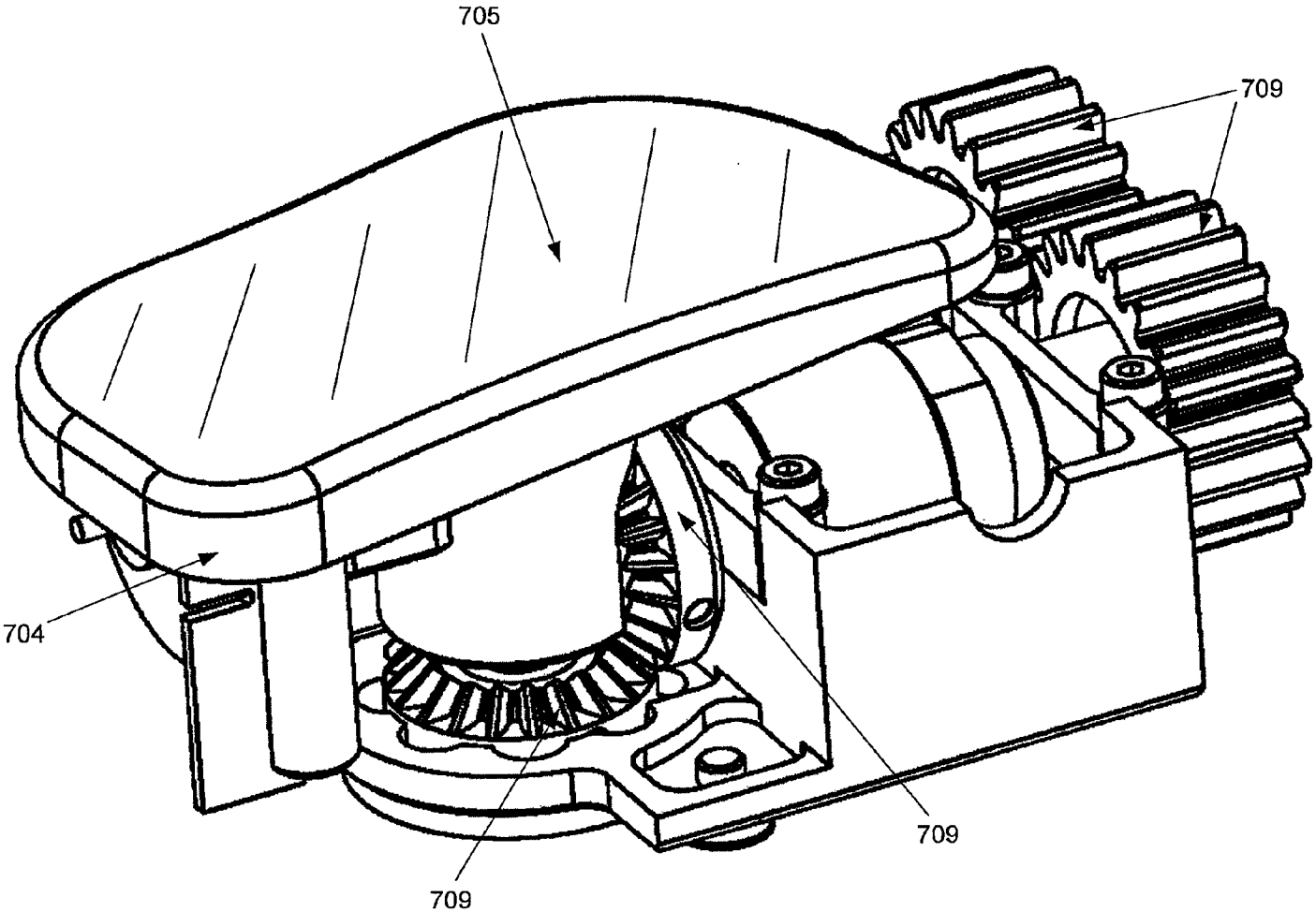
Figure 7D:
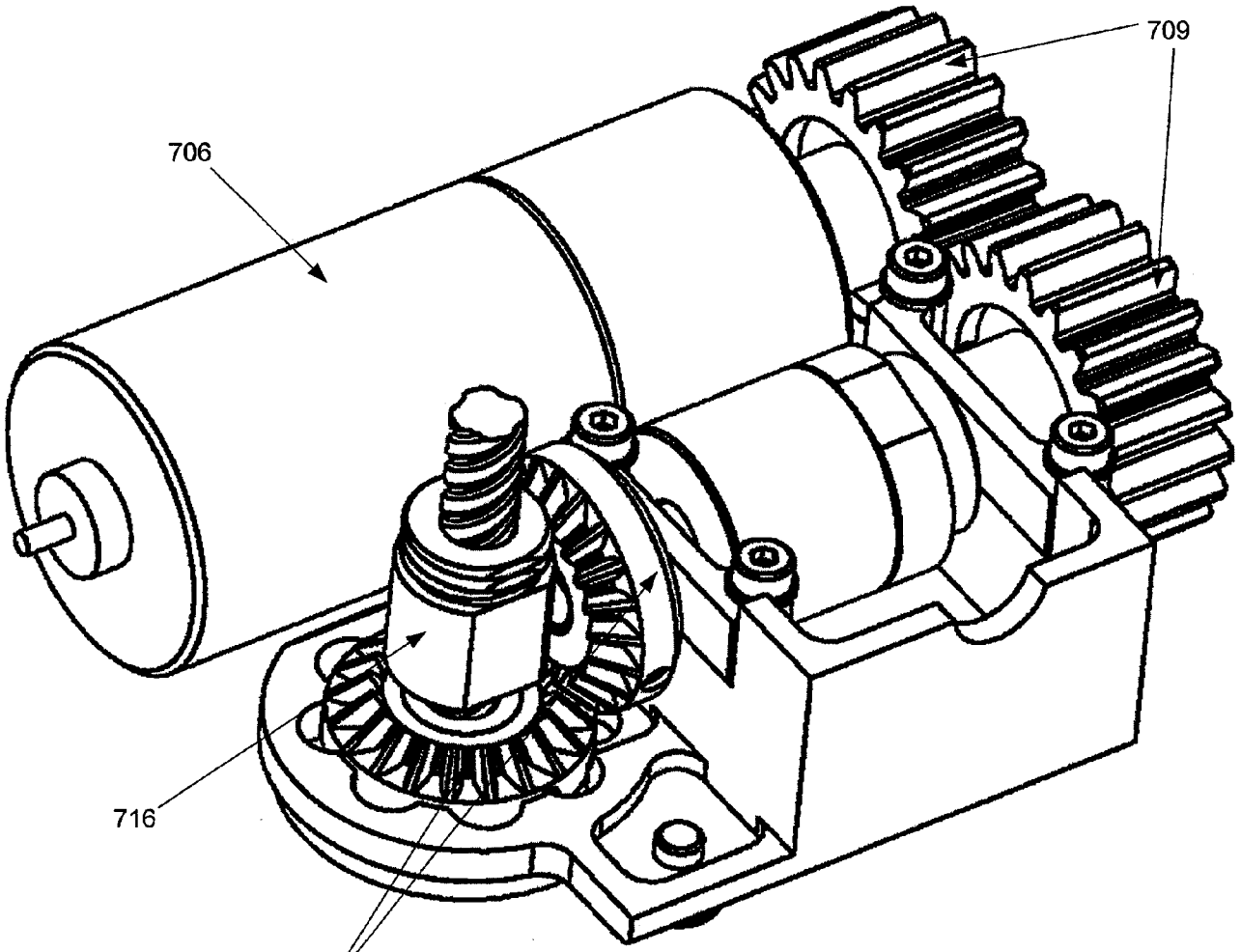

With momentary reference to FIG. 6A, in accordance with an exemplary embodiment a method 610 for implementing athletic recovery in a person following exercise comprises moving a pressure pad into contact with a foot (step 611), moving a pressure pad out of contact with the foot (step 612), and moving the pressure pad into contact with the foot (step 613). The pressure pad may be repeatedly moved as described above in order to facilitate blood flow. Turning now to FIG. 6B, in accordance with an exemplary embodiment a method 620 for implementing athletic recovery in an athlete comprises: optionally, utilizing foot compression system 100 prior to an athletic event (step 621), participating in the athletic event (step 622), and utilizing foot compression system 100 subsequent to the athletic event (step 623). Each of steps 621 and 623 may comprise any suitable use of foot compression system 100, for example method 610. Moreover, steps 621 and/or 623 may be performed at any suitable time prior to and/or subsequent to the athletic event, and foot compression system 100 may be utilized for any desired length of time (for example, 15 minutes, 30 minutes, one hour, and/or the like). Moreover, foot compression system 100 may be utilized for a length of time specified by a physician.

In various exemplary embodiments, foot compression system 100 is configured for use by individuals who are in fixed, standing, and/or sitting positions for extended periods of time, for example office workers, pregnant women, passengers on long-haul airline flights in excess of four hours, individuals in wheelchairs, service workers whose positions require standing, hospital patients, and/or the like. By improving blood flow in the lower extremities and legs, foot compression system 100 can reduce the negative health impacts associated with extended standing, extended sitting, and/or reduced mobility or immobility of a portion of the body. Moreover, foot compression system 100 may be configured for use in connection with treatment of plantar fasciitis or other disorders of the foot.

Turning now to FIGS. 7A-7D, in various exemplary embodiments a foot compression system 100, for example foot compression system 700, may be configured with various power transmission components, gearings, controls, and/or the like. In an exemplary embodiment, foot compression system 700 comprises main housing 702, pressure pad 704, pad top 705, motor 706, gears 709, slip clutch 716, and electrical components 718. Main housing 702 may be similar to main housing 102. Pressure pad 704 may be similar to pressure pad 104, and pad top 705 may be similar to pad top 105. Motor 706 may be similar to motor 106. Gears 709 may comprise any suitable number of and/or configuration of power transmission components configured to transfer power from motor 706 to pressure pad 104, for example spur gears, bevel gears, worm gears, and/or the like. Slip clutch 716 may be similar to slip clutch 116, and electrical components 718 may be similar to electrical components 118. Moreover, in various exemplary embodiments foot compression system 700 may be entirely self-contained; stated another way, foot compression system 700 may be configured as a stand-alone unit wherein all components necessary for operation of foot compression system 700 are contained within and/or physically coupled to main housing 702, and a separate reader portion is not utilized.

Figure 8:
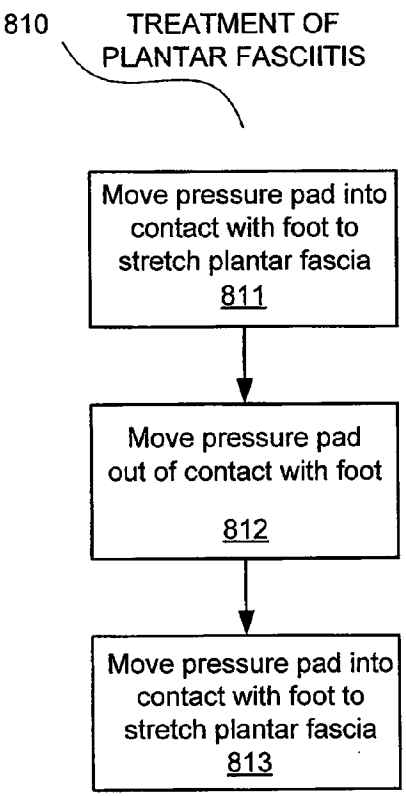

In various exemplary embodiments, with reference now to FIG. 8, foot compression system 100 may be utilized in connection with treatment of plantar fasciitis. In these embodiments, activation of foot compression system 100 is not primarily directed to increasing circulation and/or vascularity (though these results may be present); rather, activation of foot compression system 100 is directed to stretching, massaging, and/or otherwise treating the plantar fascia and/or the surrounding tissue and components of the foot. In an exemplary embodiment, foot compression system 100 is utilized to stretch the plantar fascia via extension of pressure pad 104.

In an exemplary embodiment, in connection with a method 810 for treating plantar fasciitis, pressure pad 104 is extended into contact with a foot in order to stretch the plantar fascia. Pressure pad 104 may be placed in contact with a foot (step 811) for a desired period of time in order to stretch the plantar fascia. In accordance with an exemplary embodiment, when moved to the fully extended position, pressure pad 104 may generate a pressure between about 1 mmHg and 250 mmHg against the person's foot. Further, pressure pad 104 may be extended with a force between about 25 Newtons and 80 Newtons in certain exemplary embodiments. Pressure pad 104 may be kept in an extended position for a time between about 1 second and about 6 seconds. Pressure pad 104 is then retracted (step 812). Pressure pad 104 may then be re-extended (step 813), such as after a delay of between about 10 and 60 seconds. However, other time frames can be used, and all suitable time frames are thought to fall within the scope of the present disclosure.

In various exemplary embodiments, when utilized for treatment of plantar fasciitis, foot compression system 100 may be utilized any suitable number of times in a day. In an exemplary embodiment, foot compression system 100 is used for treatment of plantar fasciitis once a day. In another exemplary embodiment, foot compression system 100 is used for treatment of plantar fasciitis twice a day. Moreover, foot compression system 100 may also be used more than twice a day, on alternating days, and/or on any other suitable time schedule, as desired.

In various exemplary embodiments, when utilized for treatment of plantar fasciitis, foot compression system 100 may be utilized for any suitable duration. In an exemplary embodiment, foot compression system 100 is used for treatment of plantar fasciitis for about 30 minutes at a time. In another exemplary embodiment, foot compression system 100 is used for treatment of plantar fasciitis for about one hour at a time. Moreover, foot compression system 100 may be used for between about fifteen minutes and about eight hours at a time, and/or for any other suitable duration, as desired.

Figure 9:
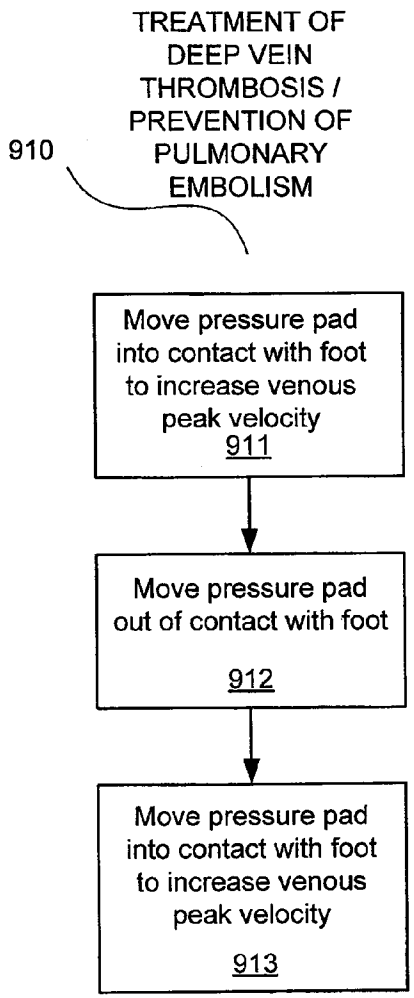

Turning now to FIG. 9, in various exemplary embodiments, foot compression system 100 may be utilized in connection with treatment of deep vein thrombosis and/or prevention of pulmonary embolism. In these embodiments, activation of foot compression system 100 may be primarily directed to increasing venous peak velocity. Additionally, improved circulation and/or vascularity may be achieved. In an exemplary embodiment, foot compression system 100 is utilized to increase venous peak velocity via extension of pressure pad 104.

In an exemplary embodiment, in connection with a method 910 for treatment of deep vein thrombosis and/or prevention of pulmonary embolism, pressure pad 104 is extended into contact with a foot in order to force blood through the venous plexus. Pressure pad 104 may be placed in contact with a foot (step 911) for a desired period of time in order to force blood through the venous plexus. In accordance with an exemplary embodiment, when moved to the fully extended position, pressure pad 104 may generate a pressure between about 1 mmHg and 500 mmHg against the person's foot. Further, pressure pad 104 may be extended with a force between about 50 Newtons and 125 Newtons in certain exemplary embodiments. Pressure pad 104 may be kept in an extended position for a time between about 1 and 3 seconds. Pressure pad 104 is then retracted (step 912). Pressure pad 104 may then be re-extended (step 913), such as after a delay of between about 20 and 40 seconds. However, other time frames can be used, and all suitable time frames are thought to fall within the scope of the present disclosure.

In various exemplary embodiments, in connection with a method 910 for treatment of deep vein thrombosis and/or prevention of pulmonary embolism, extension of pressure pad 104 is configured to raise the peak femoral venous velocity in a patient via compression of the venous plexus. In an exemplary embodiment, compression of the venous plexus via extension of pressure pad 104 results in peak femoral venous velocity in excess of 30 centimeters per second (cm/s). In another exemplary embodiment, compression of the venous plexus via extension of pressure pad 104 results in peak femoral venous velocity in excess of 40 cm/s. In another exemplary embodiment, compression of the venous plexus via extension of pressure pad 104 results in peak femoral venous velocity in excess of 45 cm/s. Moreover, foot compression system 100 may be utilized to compress the venous plexus in order to achieve any suitable peak femoral venous velocity in a patient, and the foregoing examples are by way of illustration and not of limitation In various exemplary embodiments, when utilized for treatment of deep vein thrombosis and/or prevention of pulmonary embolism, foot compression system 100 may be utilized any suitable number of times in a day. In an exemplary embodiment, foot compression system 100 is used for treatment of treatment of deep vein thrombosis and/or prevention of pulmonary embolism once a day. In another exemplary embodiment, foot compression system 100 is used for treatment of deep vein thrombosis and/or prevention of pulmonary embolism twice a day. Moreover, foot compression system 100 may also be used more than twice a day, on alternating days, continuously, and/or on any other suitable time schedule, as desired.

In various exemplary embodiments, when utilized for treatment of deep vein thrombosis and/or prevention of pulmonary embolism, foot compression system 100 may be utilized for any suitable duration. In an exemplary embodiment, foot compression system 100 is used 24 hours a day. In another exemplary embodiment, foot compression system 100 is used for treatment of deep vein thrombosis and/or prevention of pulmonary embolism for about 12 hours at a time. Moreover, foot compression system 100 may be used for between about three hours and about 6 hours at a time, and/or for any other suitable duration, as desired.

Figure 10:
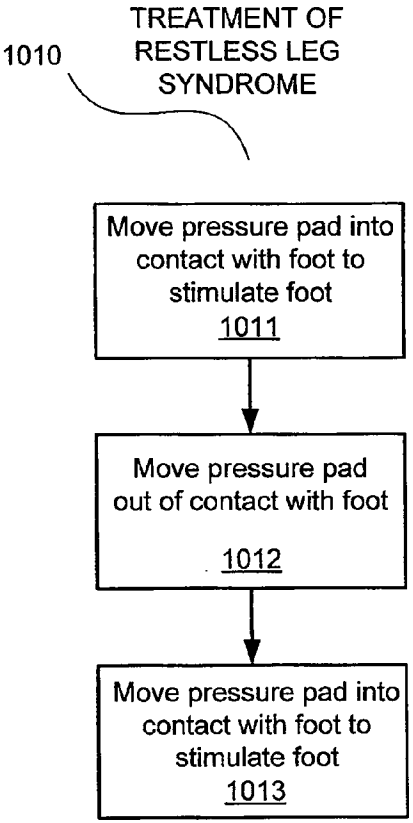
FIGS. 8-13 illustrate methods of using a foot compression system in accordance with various exemplary embodiments.

Turning now to FIG. 10, in various exemplary embodiments, foot compression system 100 may be utilized in connection with treatment of restless leg syndrome. In these embodiments, activation of foot compression system 100 may be directed to increasing blood flow in the foot and/or leg, stimulation of nerves in the foot and/or leg, and/or the like. Additionally, improved circulation and/or vascularity may be achieved. In an exemplary embodiment, foot compression system 100 is utilized to stimulate the foot via extension of pressure pad 104.

In an exemplary embodiment, in connection with a method 1010 for treating restless leg syndrome, pressure pad 104 is extended into contact with a foot in order to stimulate the foot. Pressure pad 104 may be placed in contact with a foot (step 1011) for a desired period of time in order to stimulate the foot. In accordance with an exemplary embodiment, when moved to the fully extended position, pressure pad 104 may generate a pressure between about 1 mmHg and 300 mmHg against the person's foot. Further, pressure pad 104 may be extended with a force between about 25 Newtons and 75 Newtons in certain exemplary embodiments. Pressure pad 104 may be kept in an extended position for a time between about 1 and 3 seconds. Pressure pad 104 is then retracted (step 1012). Pressure pad 104 may then be re-extended (step 1013), such as after a delay of between about 20 and 30 seconds. However, other time frames can be used, and all suitable time frames are thought to fall within the scope of the present disclosure.

In various exemplary embodiments, when utilized for treatment of restless leg syndrome, foot compression system 100 may be utilized any suitable number of times in a day. In an exemplary embodiment, foot compression system 100 is used for treatment of restless leg syndrome once a day, for example between about 1 hour and about 3 hours before retiring to bed. In another exemplary embodiment, foot compression system 100 is used for treatment of restless leg syndrome twice a day, for example within about 1 hour and about 3 hours of arising in the morning, and between about 1 hour and about 3 hours before retiring to bed. Moreover, foot compression system 100 may also be used more than twice a day, on alternating days, and/or on any other suitable time schedule, as desired. In certain exemplary embodiments, foot compression system 100 may be utilized on an "as-needed" basis to treat symptoms of restless leg syndrome in real-time as they are occurring.

In various exemplary embodiments, when utilized for treatment of restless leg syndrome, foot compression system 100 may be utilized for any suitable duration. In an exemplary embodiment, foot compression system 100 is used for treatment of restless leg syndrome for between about one hour and about three hours at a time. Moreover, foot compression system 100 may be used for any other suitable duration, as desired.

Figure 11:
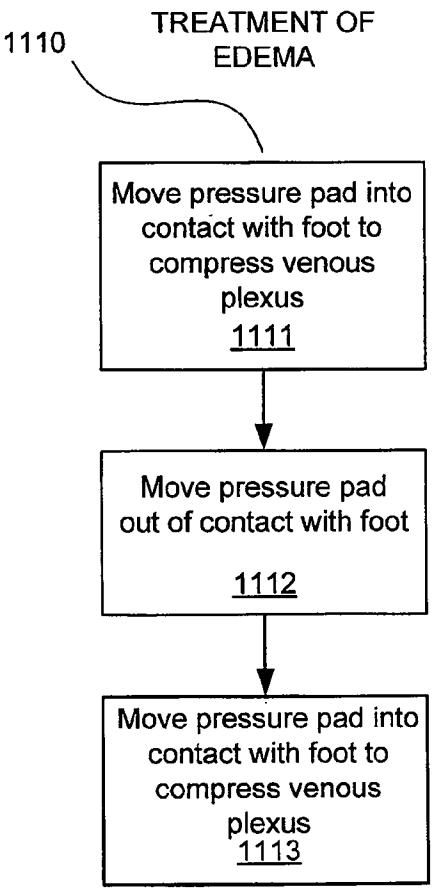

Turning now to FIG. 11, in various exemplary embodiments, foot compression system 100 may be utilized in connection with treatment of edema. In these embodiments, activation of foot compression system 100 may be directed to increasing circulation and/or vascularity in a portion of a human body. In an exemplary embodiment, foot compression system 100 is utilized to compress the venous plexus region of the foot via extension of pressure pad 104.

In an exemplary embodiment, in connection with a method 1110 for treating edema, pressure pad 104 is extended into contact with a foot in order to force blood from the venous plexus region of the foot. Pressure pad 104 may be placed in contact with a foot (step 1111) for a desired period of time in order to force blood from the venous plexus. In accordance with an exemplary embodiment, when moved to the fully extended position, pressure pad 104 may generate a pressure between about 1 mmHg and 500 mmHg against the person's foot. Further, pressure pad 104 may be extended with a force between about 25 Newtons and 125 Newtons in certain exemplary embodiments. Pressure pad 104 may be kept in an extended position for a time between about 1 second and about 5 seconds. Pressure pad 104 is then retracted (step 1112) in order to allow the venous plexus to at least partially refill with blood. Pressure pad 104 may then be re-extended (step 1113) to force blood from the venous plexus, such as after a delay of between about 30 seconds and about 60 seconds. However, other time frames can be used, and all suitable time frames are thought to fall within the scope of the present disclosure.

In various exemplary embodiments, when utilized for treatment of edema, foot compression system 100 may be utilized any suitable number of times in a day. In an exemplary embodiment, foot compression system 100 is used for treatment of edema once a day. In another exemplary embodiment, foot compression system 100 is used for treatment of edema twice a day. Moreover, foot compression system 100 may also be used more than twice a day, on alternating days, and/or on any other suitable time schedule, as desired. In certain exemplary embodiments, foot compression system 100 may be utilized on an "as-needed" basis to treat symptoms of edema in real-time, for example responsive to patient discomfort.

In various exemplary embodiments, when utilized for treatment of edema, foot compression system 100 may be utilized for any suitable duration. In an exemplary embodiment, foot compression system 100 is used for treatment of edema for between about one hour and about eight hours at a time. Moreover, foot compression system 100 may be used for any other suitable duration, as desired.

Figure 12:
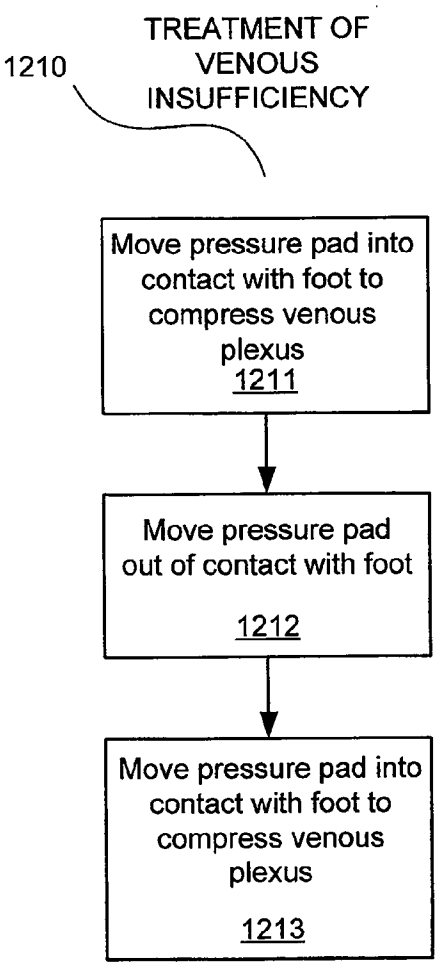

Turning now to FIG. 12, in various exemplary embodiments, foot compression system 100 may be utilized in connection with treatment of venous insufficiency. In these embodiments, activation of foot compression system 100 may be directed to increasing circulation, counteracting the effect of damaged valves in one or more veins, and/or the like. In an exemplary embodiment, foot compression system 100 is utilized to compress the venous plexus region of the foot via extension of pressure pad 104.

In an exemplary embodiment, in connection with a method 1210 for treating venous insufficiency, pressure pad 104 is extended into contact with a foot in order to force blood from the venous plexus region of the foot. Pressure pad 104 may be placed in contact with a foot (step 1211) for a desired period of time in order to force blood from the venous plexus. In accordance with an exemplary embodiment, when moved to the fully extended position, pressure pad 104 may generate a pressure between about 1 mmHg and 500 mmHg against the person's foot. Further, pressure pad 104 may be extended with a force between about 25 Newtons and 125 Newtons in certain exemplary embodiments. Pressure pad 104 may be kept in an extended position for a time between about 1 second and about 5 seconds. Pressure pad 104 is then retracted (step 1212) in order to allow the venous plexus to at least partially refill with blood. Pressure pad 104 may then be re-extended (step 1213) to force blood from the venous plexus, such as after a delay of between about 30 seconds and about 60 seconds. However, other time frames can be used, and all suitable time frames are thought to fall within the scope of the present disclosure.

In various exemplary embodiments, when utilized for treatment of venous insufficiency, foot compression system 100 may be utilized any suitable number of times in a day. In an exemplary embodiment, foot compression system 100 is used for treatment of venous insufficiency once a day. In another exemplary embodiment, foot compression system 100 is used for treatment of venous insufficiency twice a day. Moreover, foot compression system 100 may also be used more than twice a day, on alternating days, and/or on any other suitable time schedule, as desired. In certain exemplary embodiments, foot compression system 100 may be utilized on an "as-needed" basis to treat symptoms of venous insufficiency in real-time, for example responsive to patient discomfort.

In various exemplary embodiments, when utilized for treatment of venous insufficiency, foot compression system 100 may be utilized for any suitable duration. In an exemplary embodiment, foot compression system 100 is used for treatment of venous insufficiency for between about one hour and about twelve hours at a time. Moreover, foot compression system 100 may be used for any other suitable duration, as desired.

Figure 13:
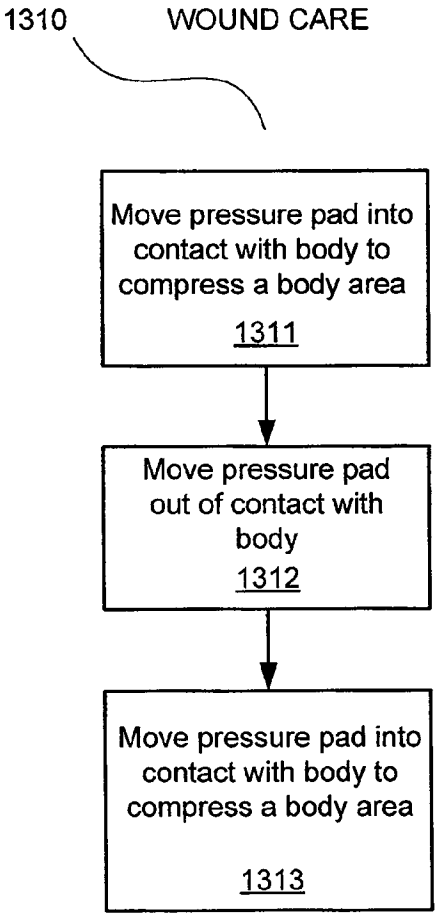

Turning now to FIG. 13, in various exemplary embodiments, foot compression system 100 may be utilized in connection with treatment of wounds. In these embodiments, activation of foot compression system 100 may be directed to increasing blood circulation and/or vascularity at and/or around a wound site. Moreover, in connection with wound care, use of foot compression system 100 may be guided and/or governed by the circulatory capacity of the body in the region of a wound. Stated another way, foot compression system 100 may be configured to increase circulation in the region of a wound without exceeding the circulatory capacity of the region of the wound. In an exemplary embodiment, foot compression system 100 is utilized to compress a portion of the body, for example the venous plexus region of the foot, via extension of pressure pad 104.

In an exemplary embodiment, in connection with a method 1310 for wound care, pressure pad 104 is extended into contact with a portion of a body, for example a foot, in order to force blood from the portion of the body and/or otherwise assist in "pumping" blood through a region of the body. Pressure pad 104 may be placed in contact with the body (step 1311) for a desired period of time in order to force blood therethrough. In accordance with an exemplary embodiment, when moved to the fully extended position, pressure pad 104 may generate a pressure between about 1 mmHg and 200 mmHg against the body. Further, pressure pad 104 may be extended with a force between about 12 Newtons and 75 Newtons in certain exemplary embodiments. Pressure pad 104 may be kept in an extended position for a time between about 1 second and about 5 seconds. Pressure pad 104 is then retracted (step 1312) in order to allow the portion of the body to at least partially refill with blood. Pressure pad 104 may then be re-extended (step 1313) to force blood from the portion of the body, such as after a delay of between about 30 seconds and about 60 seconds. However, other time frames can be used, and all suitable time frames are thought to fall within the scope of the present disclosure.

In various exemplary embodiments, when utilized for wound care, foot compression system 100 may be utilized any suitable number of times in a day. In an exemplary embodiment, foot compression system 100 is used for wound care once a day. In another exemplary embodiment, foot compression system 100 is used for wound care twice a day. Moreover, foot compression system 100 may also be used more than twice a day, on alternating days, and/or on any other suitable time schedule, as desired. In certain exemplary embodiments, foot compression system 100 may be utilized on a continuous basis to provide a steadily elevated level of circulation in the region of a wound.

In various exemplary embodiments, when utilized for wound care, foot compression system 100 may be utilized for any suitable duration. In an exemplary embodiment, foot compression system 100 is used for wound care for between about one hour and about 24 hours at a time. Moreover, foot compression system 100 may be used for any other suitable duration, as desired.

The present disclosure has been described above with reference to various exemplary embodiments. However, those skilled in the art will recognize that changes and modifications may be made to the exemplary embodiments without departing from the scope of the present disclosure. For example, the various operational steps, as well as the components for carrying out the operational steps, may be implemented in alternate ways depending upon the particular application or in consideration of any number of cost functions associated with the operation of the system, e.g., one or more of the steps may be deleted, modified, or combined with other steps. Further, it should be noted that while the methods and systems for compression described above are suitable for use on the foot, similar approaches may be used on the hand, calf, or other areas of the body. These and other changes or modifications are intended to be included within the scope of the present disclosure.

Moreover, as will be appreciated by one of ordinary skill in the art, principles of the present disclosure may be reflected in a computer program product on a tangible computer-readable storage medium having computer-readable program code means embodied in the storage medium. Any suitable computer-readable storage medium may be utilized, including magnetic storage devices (hard disks, floppy disks, and the like), optical storage devices (CD-ROMs, DVDs, Blu-Ray discs, and the like), flash memory, and/or the like. These computer program instructions may be loaded onto a general purpose computer, special purpose computer, or other programmable data processing apparatus to produce a machine, such that the instructions that execute on the computer or other programmable data processing apparatus create means for implementing the functions. These computer program instructions may also be stored in a computer-readable memory that can direct a computer or other programmable data processing apparatus to function in a particular manner, such that the instructions stored in the computer-readable memory produce an article of manufacture including instruction means which implement the function specified. The computer program instructions may also be loaded onto a computer or other programmable data processing apparatus to cause a series of operational steps to be performed on the computer or other programmable apparatus to produce a computer-implemented process such that the instructions which execute on the computer or other programmable apparatus provide steps for implementing the functions specified.

In the foregoing specification, the disclosure has been described with reference to various embodiments. However, one of ordinary skill in the art appreciates that various modifications and changes can be made without departing from the scope of the present disclosure as set forth in the claims below. Accordingly, the specification is to be regarded in an illustrative rather than a restrictive sense, and all such modifications are intended to be included within the scope of the present disclosure. Likewise, benefits, other advantages, and solutions to problems have been described above with regard to various embodiments. However, benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. Also, as used herein, the terms "coupled," "coupling," or any other variation thereof, are intended to cover a physical connection, an electrical connection, a magnetic connection, an optical connection, a communicative connection, a functional connection, and/or any other connection. Further, when language similar to "at least one of A, B, or C" is used in the claims, the phrase is intended to mean any of the following: (1) at least one of A; (2) at least one of B; (3) at least one of C; (4) at least one of A and at least one of B; (5) at least one of B and at least one of C; (6) at least one of A and at least one of C; or (7) at least one of A, at least one of B, and at least one of C.

What is claimed is:

1. A method of treating plantar fasciitis, comprising:

moving, by a foot compression system completely contained within an item of footwear, a non-bendable pressure pad a first time to bring the pressure pad into contact with a foot of a patient to stretch the plantar fascia;

moving, by the foot compression system, the pressure pad a second time to bring the pressure pad out of contact with the foot to allow the plantar fascia to relax; and moving, by the foot compression system, the pressure pad a third time to bring the pressure pad into contact with the foot to stretch the plantar fascia, wherein the moving the non-bendable pressure pad a first time, a second time, and a third time occurs when the patient is not walking.

2. The method of claim 1, wherein the pressure pad is held in contact with the foot to stretch the plantar fascia for a duration of between 1 seconds and 5 seconds.

3. A method of treating plantar fasciitis, comprising:

moving, by a foot compression system, a non-bendable pressure pad a first time to bring the pressure pad into contact with a foot of a patient to stretch the plantar fascia;

moving, by the foot compression system, the pressure pad a second time to bring the pressure pad out of contact with the foot to allow the plantar fascia to relax; and moving, by the foot compression system, the pressure pad a third time to bring the pressure pad into contact with the foot to stretch the plantar fascia, wherein the foot compression system is completely contained within an item of footwear, and wherein the foot compression system comprises:

a motor coupled to the pressure pad via a gear; and a slip clutch coupling the pressure pad and the motor, the slip clutch configured to allow the pressure pad to retract responsive to an applied force exceeding a predetermined value.

4. A method of treating restless leg syndrome, comprising:

moving, by a foot compression system completely contained within an item of footwear, a non-bendable pressure pad a first time to bring the pressure pad into contact with a foot of a patient to stimulate the foot;

moving, by the foot compression system, the pressure pad a second time to bring the pressure pad out of contact with the foot; and moving, by the foot compression system, the pressure pad a third time to bring the pressure pad into contact with the foot to stimulate the foot, wherein the moving the non-bendable pressure pad a first time, a second time, and a third time occurs when the patient is not walking.

5. The method of claim 4, wherein the foot compression system is used to bring the pressure pad into contact with the foot and out of contact with the foot during at least a portion of the period from between about 3 hours before the patient retires to bed to about 1 hour before the patient retires to bed.

6. The method of claim 4, wherein the delay between the moving the pressure pad the first time and the moving the pressure pad the second time is between about 20 seconds and about 30 seconds.

7. A method of treating deep vein thrombosis, comprising:

moving, by a foot compression system completely contained within an item of footwear, a non-bendable pressure pad a first time to bring the pressure pad into contact with a foot of a patient to compress a portion of the foot;

moving, by the foot compression system, the pressure pad a second time to bring the pressure pad out of contact with the foot to allow the portion of the foot to at least partially refill with blood; and moving, by the foot compression system, the pressure pad a third time to bring the pressure pad into contact with the foot to compress the portion of the foot, wherein the moving the non-bendable pressure pad a first time, a second time, and a third time occurs when the patient is not walking.

8. The method of claim 7, wherein the moving the pressure pad into contact with the foot results in a peak femoral venous velocity of at least 30 centimeters per second.

9. The method of claim 7, wherein the foot compression system is configured to prevent extension of the pressure pad responsive to an indication that the foot compression system has been moved within a predetermined time period.

10. A method of treating a medical condition selected from a group comprising deep vein thrombosis, edema, restless leg syndrome, venous insufficiency, plantar fasciitis, or a wound, comprising:

moving, by a compression system completely contained within an item of footwear, a non-bendable pressure pad a first time to bring the pressure pad into contact with a portion of a human body to compress the portion of the human body;

moving, by the compression system, the pressure pad a second time to bring the pressure pad out of contact with the portion of a human body to allow the portion of the human body to at least partially refill with blood; and moving, by the compression system, the pressure pad a third time to bring the pressure pad into contact with the portion of the human body to compress the portion of the human body, wherein the moving the non-bendable pressure pad a first time, a second time, and a third time occurs when the patient is not walking.

11. The method of claim 10, wherein the portion of the human body is a foot.

12. A method of preventing a pulmonary embolism, comprising:

moving, by a compression system completely contained within an item of footwear, a non-bendable pressure pad a first time to bring the pressure pad into contact with a portion of a human body to compress the portion of the human body;

moving, by the compression system, the pressure pad a second time to bring the pressure pad out of contact with the portion of a human body to allow the portion of the human body to at least partially refill with blood; and moving, by the compression system, the pressure pad a third time to bring the pressure pad into contact with the portion of the human body to compress the portion of the human body, wherein the moving the non-bendable pressure pad a first time, a second time, and a third time occurs when the patient is not walking.

13. The method of claim 12, wherein the portion of the human body is the foot.

* * * * *